US011648582B2

(12) United States Patent
Bublewitz et al.

(10) Patent No.: US 11,648,582 B2
(45) Date of Patent: May 16, 2023

(54) APPLICATION SYSTEM

(71) Applicant: 3LMED GMBH, Marburg/Lahn (DE)

(72) Inventors: Alexander Bublewitz, Herborn (DE); Jens-Peter Reber, Meinerzhagen (DE)

(73) Assignee: 3LMED GMBH, Marburg (DE)

( * ) Notice: Subject to any disclaimer, the term of this patent is extended or adjusted under 35 U.S.C. 154(b) by 288 days.

(21) Appl. No.: 16/633,125

(22) PCT Filed: Aug. 2, 2018

(86) PCT No.: PCT/EP2018/070990
§ 371 (c)(1),
(2) Date: Jan. 22, 2020

(87) PCT Pub. No.: WO2019/025539
PCT Pub. Date: Feb. 7, 2019

(65) Prior Publication Data

US 2021/0154697 A1 May 27, 2021

(30) Foreign Application Priority Data

Aug. 2, 2017 (DE) ..... 102017117557.1

(51) Int. Cl.
*B05C 17/005* (2006.01)
*B65D 51/24* (2006.01)
(Continued)

(52) U.S. Cl.
CPC .. *B05C 17/00513* (2013.01); *B05C 17/00553* (2013.01); *B65D 51/245* (2013.01);
(Continued)

(58) Field of Classification Search
CPC ..... B05C 17/00513; B05C 17/00553; B65D 51/245; B65D 51/28; B65D 55/02;
(Continued)

(56) References Cited

U.S. PATENT DOCUMENTS 4,457,437 A * 7/1984 Heath, Jr. ..... B65D 41/3409 215/206
4,572,385 A * 2/1986 Luker ..... B65D 50/046 215/216
(Continued)

FOREIGN PATENT DOCUMENTS

DE 20104819 U1 6/2001
DE 20309931 U1 11/2004
(Continued)

OTHER PUBLICATIONS

Canadian Office Action for corresponding Canadian application No. 3,070,150, dated Apr. 20, 2021.
(Continued)

*Primary Examiner* — Bob Zadeh
(74) *Attorney, Agent, or Firm* — McDonnell Boehnen Hulbert & Berghoff LLP

(57) ABSTRACT

The present disclosure relates to an application system with a cartridge having at least one container with a respective outlet, and a closure element that can sealingly close the outlet of the at least one container when the cartridge is in the delivery state. When in the storage state, the cartridge sealingly closes the closure element. When the cartridge is in the state of use, the closure element can be removed therefrom and an accessory can be connected to the outlet of the at least one container. According to the invention, the cartridge or the closure element comprises, in the delivery state, a connecting element which cannot be removed without being damaged, and the cartridge or the closure element, in the storage state, is connected via a connecting element that cannot be removed without being damaged, to a closure element or the cartridge.

13 Claims, 23 Drawing Sheets

(51) Int. Cl.
*B65D 51/28* (2006.01)
*B65D 55/02* (2006.01)
*B65D 83/00* (2006.01)

(52) U.S. Cl.
CPC ..... *B65D 51/28* (2013.01); *B65D 55/02* (2013.01); *B65D 83/0016* (2013.01); *B65D 2203/10* (2013.01); *B65D 2401/10* (2020.05)

(58) Field of Classification Search
CPC ..... B65D 83/0016; B65D 2203/10; B65D 2401/10; B65D 55/024; B65D 83/0005
See application file for complete search history.

(56) References Cited

U.S. PATENT DOCUMENTS 4,640,427 A * 2/1987 Marino ..... B65D 55/06 215/253
4,702,383 A * 10/1987 Wender ..... B65D 41/3495 215/230
7,306,130 B2 12/2007 Brugner
9,550,159 B2 1/2017 Bublewitz et al.
9,700,859 B2 7/2017 Bublewitz et al.
2001/0015936 A1 8/2001 Heusser
2002/0145007 A1* 10/2002 Sawhney ..... B05C 17/00506 222/137
2002/0170926 A1* 11/2002 Horner ..... B05C 17/0052 222/326
2004/0188465 A1* 9/2004 Timmerman ..... B65D 47/36 222/145.5
2007/0023452 A1* 2/2007 Tseng ..... B05B 11/306 222/153.13
2009/0050596 A1 2/2009 Fuchs
2009/0230214 A1* 9/2009 Keller ..... A61C 5/64 239/338
2010/0102088 A1* 4/2010 Keller ..... B65D 81/325 222/137
2010/0163579 A1* 7/2010 Keller ..... B05C 17/00506 222/137
2012/0061343 A1* 3/2012 Habibi-Naini ..... B65D 81/325 215/222
2012/0248058 A1 10/2012 Habibi-Naini
2013/0105515 A1 5/2013 Frey et al.
2013/0220967 A1* 8/2013 Wang ..... B65D 47/0838 215/253
2014/0197204 A1 7/2014 Bublewitz et al.
2015/0048112 A1* 2/2015 Skillin ..... B65D 75/5883 222/107
2016/0318668 A1* 11/2016 Wuethrich ..... B65D 41/3404
2017/0015459 A1* 1/2017 Warner ..... B65D 55/06
2021/0154697 A1* 5/2021 Bublewitz ..... B65D 83/0016

FOREIGN PATENT DOCUMENTS

DE 102012003390 A1 * 2/2013 ..... B05C 17/00576
DE 102012003390 A1 2/2013
DE 202012013429 U1 2/2017
EP 1078867 A2 * 2/2001 ..... B65D 81/3205
EP 1304086 A2 4/2003
EP 1757528 B1 12/2011
GB 2339546 A 2/2000
JP H1053251 A * 2/1998 ..... B65D 75/5883
JP 2010-521384 A 6/2010
JP 2011-093559 A 5/2011
JP 2012-062094 A 3/2012
KR 10-2009-0121340 A 11/2009
WO 2006/092077 A1 9/2006
WO 2006092077 A1 9/2006
WO WO-2006092077 A1 * 9/2006 ..... B65D 41/3495
WO 2011/073251 A1 6/2011
WO 2011128371 A1 10/2011
WO 2013/026717 A1 2/2013
WO 2013/026721 A1 2/2013

OTHER PUBLICATIONS

International Search Report and Written Opinion for Int. App. No. PCT/EP2018/070990, dated Feb. 21, 2019.

* cited by examiner

Cut A-A

Cut B-B

APPLICATION SYSTEM

CROSS REFERENCE TO RELATED APPLICATIONS

The present application is a U.S. National Phase Application pursuant to 35 U.S.C. § 371 of International Application No. PCT/EP2018/070990 filed Aug. 2, 2018, which claims priority to German Patent Application No. 10 2017 117 557.1 filed Aug. 2, 2017. The entire disclosure contents of these applications are herewith incorporated by reference into the present application.

TECHNICAL FIELD

The present disclosure relates to an application system, such as a cartridge system, for example, with a cartridge that has at least one container and with a single- or multi-part closure element. There is also understood by cartridge, in particular, a container with an outlet, whereby the end of the container positioned opposite the outlet can be provided with a displaceable dispensing piston. There is understood by cartridge in the following a dispensing injector or a so-called compule. If several containers of cartridges are provided, then each one of these has an outlet. The respective outlets of the container in a storage state of the cartridge can thereby be sealingly closed by the closure element.

BACKGROUND

In order to move the cartridge into a state of use, the closure element is removable from the cartridge. The cartridge is thereby designed in such a way that an accessory, such as an applicator or a mixer, is connectable with the cartridge, particularly with the outlets of the container, for example. Such a cartridge system is known, for example, from WO 2013/026721 A1.

It is known, in the area of beverage bottles, to provide so-called tamper-evident safety seals, by means of which it can be indicated, through the breaking of predetermined breaking points, either on the container or on the closure, whether the container has already been previously opened, even after the replacing of the closure on the container. EP 1 757 528 B1 describes such a tamper-evident safety seal, in which a tamper-evident ring is separated from a closure cap if the closure cap is removed from the bottle for the first time. The tamper-evident ring thereby remains on the neck of the bottle after the opening.

DE 201 04 819 U1 describes a double cartridge, the outlets of which are sealed with a tamper-evident safety seal. After the removal of the tamper-evident safety seal, the cartridge can be sealingly closed with a separate closure, which can be connected with the outlets only in a defined manner in order to prevent cross-contamination of the stored materials.

US 2013/0 105 515 A1 likewise discloses a double cartridge with a closure, which is designed to be able to be torn off from the cartridge.

JP 2011 093 559 A describes a refillable container, such as for a liquid soap dispenser, for example. The refillable container is sealed by means of a cap provided with an insert. After the removal of the cap, the insert remains in the container and thus increases the sealing for the dosing device to be used.

US 2012/0 061 343 A1 describes a child-secure closure for a dispensing assembly. A safety cap, which can be pulled over the actual closure, is provided for that.

WO 2011/073 251 A1 and US 2002/0 170 926 A1 describe a closure plug, which is designed in a single piece with the neck of a cartridge by means of a predetermined breaking point on a bridging element. After the breaking off of the closure plug from the outlet of the cartridge, the lock projections can be sealingly plugged into the outlet.

US 2002/0 170 926 A1 describes a cartridge system for the storage and the delivery of several components. The cartridge comprises a cap that can be torn off and which, before use, seals off the outlet passages, is released for the dispensing from the outlet, and has plugs that can be inserted into the outlets of the cartridge, so that the cartridge is re-sealable.

DE 203 09 931 U1 describes different embodiments of a closure plug, which is connected with the outlets of a cartridge by way of predetermined breaking points. The closure is connected with a cover by means of a tamper-evident ring. If a pulling force is exerted on the tamper-evident ring, then the covers break off at predetermined breaking points and the cartridge is opened. The sections connected by way of the predetermined breaking points still remain on the openings.

It is thereby particularly disadvantageous that, after the removal of the closure cap, no coordination between an accessory to be placed on in a fitting manner, such as an applicator or a mixer, for example, and the cartridge is possible.

SUMMARY

It is therefore an object of the present disclosure to provide an application or cartridge system of the type already stated, in which the unintended opening of the application or cartridge system during transport or storage is prevented, and in which the first-time removal of the closure element from the cartridge is indicated. An additional goal of the disclosure lies in facilitating the assignment of a corresponding accessory fitting with the cartridge.

This object is essentially solved, in accordance with the disclosure, through the fact that the cartridge is connected with the closure element in the storage state by way of a connecting element that cannot be removed without being destroyed. The connecting element thereby secures the closure element, not only in the storage state on the cartridge, so that an undesired opening of the closure element in the storage state is prevented, but can instead even indicate a first-time removal of the closure element from the cartridge, as the connecting element cannot be removed from the cartridge or the closure element, respectively, without being destroyed. If at least one part of the connecting element remains on the cartridge after the said destruction upon the first opening of the closure element, then the connecting element can, even after the removal of the closure element, be used for the purpose of distinguishing the cartridge from other cartridges which do not comprise such a connecting element or comprise a different type of connecting element, for example. This can facilitate the assignment of a corresponding accessory that is usable with the cartridge.

A storage state in the sense of the present application is understood to be an arrangement of the application system in accordance with the disclosure, in which the cartridge is sealingly closed with the closure element and is connected with the closure element in such a way that it cannot be removed without being destroyed by way of the connecting element. The cartridge or the at least one container is typically filled with a material that is protected from environmental influences by the seal of the cartridge through the closure element so that an unintended escape of the material is prevented. This filling can also only be carried out by a user, such as from the rear end of the cartridge positioned opposite to the outlets, for example, whereby the user can subsequently seal and store the cartridge with a dispensing piston. Despite the chosen term storage state, the application system does not have to be stored in the storage state but can instead be delivered in the storage state.

In a delivery state, the cartridge of the application system in accordance with the disclosure is not sealed with the closure element. It is provided, however, that at least the cartridge or the closure element is, in the delivery state, connected with the connecting element in such a way that it cannot be removed without being destroyed. It is particularly preferred that both the cartridge as well as the closure element are connected with the connecting element in such a way that it cannot be removed without being destroyed. In other words, in this preferred embodiment, the cartridge is connected with the closure element by way of the connecting element that cannot be removed without being destroyed. Despite the chosen term delivery state, the application system does not have to be delivered in the delivery state but can instead be stored in this state.

The advantages in accordance with the disclosure are thus present independently of whether the cartridge and the closure element are present in a connected or non-connected manner. In accordance with the disclosure, however, it is essential that a connecting element is attached to the cartridge and/or the closure element and that the cartridge and the closure element can be connected by way of this connecting element.

Proceeding from the storage state, the application system, which is typically filled, can be moved into a state of use through the fact that the closure element is removed from the cartridge, so that a corresponding accessory can be connected with the cartridge.

The connecting element expediently comprises at least one predetermined breaking point for the separation of the closure element from the cartridge. By this means, it is possible to hold the forces to be applied for the detachment of the closure element within a defined range, so that the closure element can be removed from the cartridge manually without tools. The provision of at least one predetermined breaking point on the connecting element can additionally contribute to the fact, that defined areas of the connecting element remain on the cartridge and/or on the closure element. Predetermined breaking points, for example, can be areas with lower material strength and/or areas weakened by perforations or recesses.

In order to indicate to a user that the closure element has been removed from the cartridge, it can be expediently if the at least one predetermined breaking point is configured in such a way that the severing of the at least one predetermined breaking point produces an acoustic and/or haptic signal in addition to the evident visibility of the separation.

In accordance with one preferred embodiment of the disclosure, the connecting element is connected with the cartridge in a firmly bonded or positively locking manner. Alternatively or additionally, the connecting element can also be connected with the closure element in a firmly bonded or positively locking manner. Such a type of firmly bonded or positively locking connection between the connecting element and the cartridge and/or the closure element can be achieved, for example, by welding, particularly if the connecting element and the cartridge or the closure element, respectively, consist of plastics that can be welded to one another, particularly injection molded parts. Such welding is possible, for example with an ultrasound welding process, by simple means even after the closure element has been applied to the cartridge, so that the expense for the mounting of the application system can be kept low. An additional possibility for a firmly bonded or positively locking connection is, for example, to inject the connecting element during the manufacture of the cartridge or of the closure element by multi-component injection molding. As an alternative to this, the connecting element can be connected with the cartridge and/or the closure element by means of adhesion, attachment and/or mechanical pressing, cold welding, shrink-fitting and/or clicking.

The closure element can also be a separate one-part or multi-part plastic part.

In accordance with one particularly preferred embodiment of the disclosure, the connecting element is provided with a coding. A coding can, for example, be a color design of the connecting element. Alternatively or additionally, the connecting element can comprise a three-dimensional contour and, therefore, a shape that is suitable for coding and/or be provided with a corresponding marking. Such a coding of the connecting element makes it possible to use the coding to identify the cartridges, for example with regard to their content and/or with regard to the corresponding accessory to be used with the cartridge.

In a further development of this inventive concept, it is provided in an application system that additionally comprises at least one corresponding accessory connectable with the cartridge, that the at least one corresponding accessory, particularly an applicator, particularly a brush, a scrubber or a cannula or a mixer, comprises a coding corresponding to the coding of the connecting element. Thus, for example, the color of the connecting element is the same color as that with which the coding of the corresponding accessory is designed, in order to be able to select, from among a large number of different accessories, the one accessory corresponding to the respective cartridge fitting. It is also possible, alternatively or additionally to such colored codes, to provide symbols fitting with one another or similar markings on connecting elements and the corresponding accessory.

With this configuration, the application system in accordance with the disclosure comprises a connecting element that fulfills several functions simultaneously. Thus, the connecting element first of all serves as a tamper-evident element to show the first-time removal of the closure element from the cartridge. Furthermore, the connecting element impedes or prevents an unintended removal of the closure element from the cartridge. Finally, the connecting element also serves to identify the cartridge among other similar cartridges and/or to assign a suitable corresponding accessory to the cartridge.

The cartridge can comprise, in accordance with one preferred embodiment, a first threading or a first bayonet means and the closure element can comprise a second threading or a second bayonet means which, in the storage state of the cartridge, engages with the first threading. In particular, the cartridge can be provided with a ring encompassing the outlets or with a collar-shaped connecting part encompassing the outlets, which has an internal thread for the connection of the closure element. The closure element can then be correspondingly provided with an external thread. As an alternative to the threading connection between cartridge and connecting element, a bayonet connection can also be provided. Thus, the cartridge can have bayonet projections and the closure element can have a corresponding bayonet platform that engages, in the storage state of the cartridge, with the bayonet projections. Expediently, the at least one corresponding accessory is provided with a connecting section that corresponds to the closure element, i.e. the corresponding accessory likewise preferably also comprises a threading that can be brought into engagement with the threading of the cartridge or corresponding bayonet-type connecting elements, respectively.

The manufacture of the application system can be simplified through the fact that the connecting element is designed either in one piece with the closure element or in one piece with the cartridge. Accordingly, the connecting element can then be connected in a firmly bonded or positively locking manner with the cartridge or the closure element, respectively. Through the configuration of the closure element with the connecting element or the cartridge in one piece, the connecting element, including the predetermined breaking point, can be produced in a single working process with the closure element or the cartridge, respectively. It is then only necessary to produce a firmly bonded or positively locking connection with the cartridge or the closure element, respectively, after the application of the closure element on the cartridge.

The closure element can be designed in an essentially multi-part manner. Thus, for example, it is preferred if the closure element consists of a first, for example inner, component, which can comprise pins which, for the sealing of the outlets of the container, can be plugged into these and consist of a second external component, which is preferably rotatably connected with the first component. The second component thereby preferably comprises threading or bayonet elements, respectively, so that a fastening and removal of the closure element can take place by means of a rotational movement, such as a helical movement, for example, relative to the cartridge if the pins of the first component engage in the outlets of the container. In a particularly preferred manner, the closure element additionally comprises a positioning element. In this multi-part configuration of the closure element, the connecting element is preferably solidly connected with the, for example external, component of the connecting element which is moved relative to the cartridge for purposes of removal.

The connecting element can be designed and positioned in such a way that the connecting element is automatically severed upon the opening of the closure element. In other words, no separate work step is necessary in order to destroy the connecting element, but this occurs during the (first) removal of the closure element from the cartridge.

As an alternative to this, however, it is also essentially possible to design the connecting element in such a way that the connecting element must first of all be destroyed or removed, before the closure element can be opened. Such types of configurations, for example, include, a film shrunk onto and/or welded onto the cartridge and the closure element or embodiments in which a tear-off ring or a tear-off cap forms the connecting element, whereby the tear-off ring or the tear-off cap, respectively, must be removed, for example, in order to be able to activate the closure element.

In a further development of this inventive concept, the connecting element according to one embodiment comprises a cap, for example a latched cap, or a union element connected with the closure element, which is connected by way of a predetermined breaking point with at least one strip, which is connected with the cartridge, for example by welding. The closure element can thereby be configured in a two-part manner, namely, with a closure insert that sealingly engages in the outlet or the outlets of the containers, and a fastening ring for the detachable connecting with the cartridge, so that the closure together with the connecting element designed as a cap is in three parts. A recess can optionally be provided in the cap, in which a foldable package insert, an RFID chip, a transponder and/or a bonus or payback coin or the like are held. For this purpose, the recess can be circular.

In accordance with an additional alternative, the closure and the cartridge are connected by means of an adhesive label, which tears upon the turning of the closure from the cartridge, as a result of which the originality can be checked, whereby a color residue and/or part of the adhesive label remains on the collar of the cartridge in any event.

In the case of an application system, which additionally comprises at least one corresponding accessory connectable with the cartridge, the connecting element is preferably designed and arranged in such a way that a part of the connecting element in every case remains visible from the outside after the connecting of the corresponding accessory with the outlets of the container. In this way, it is possible to carry out the assignment between the corresponding accessory and cartridge by means of the still visible connecting elements. In other words, it can also be subsequently checked, and therefore after the connecting of the corresponding accessory with the cartridge, whether the correct accessory is being used with the cartridge.

In accordance to a particularly preferred embodiment of the disclosure, the cartridge is provided with a ring with an internal thread, into which a two-part or multi-part closure element with an external threading component rotatable relative to an inner component can be screwed. The connecting element is thereby formed, for example, in one piece with the rotatable threading component of the closure element and welded with the ring of the cartridge. The connecting element thereby comprises two thin bars serving as predetermined breaking points, which are broken if the threading element of the closure element is unscrewed from the cartridge. The area of the connecting element welded with the ring of the cartridge thereby remains on the cartridge even after the severing of the predetermined breaking points and can indicate by means of a colored design what type of corresponding accessory can be used with the cartridge. This thereby particularly involves a colored design, whereby the corresponding accessory is a mixer with a corresponding similar color design. For example, the mixer can comprise a transparent mixer casing and a color-configured mixing coil.

In accordance with one preferred configuration of the disclosure, the connecting element comprises at least one contrast-forming three-dimensional contour. There is understood by contrast-forming three-dimensional contour any change of shape on the connecting element that changes the cross-section of the connecting element at the point of the contouring. Examples for such contourings include projections and recesses on or in the connecting element. The contrast-forming three-dimensional contourings can comprise a coding comprise or form additional symbols which facilitate the operation of the application system for a user who uses it.

In a further development of this concept, it is provided that the at least one contrast-forming three-dimensional contour forms at least one recess, whereby the recess and the connecting element are, in particular, positioned in such a way that the cartridge surface forms a contrast, particularly a color contrast, to the connecting element. For example, the cartridge surface can be colored bright and the connecting element dark, whereby the recess, in this case, likewise brightly protrudes into the connecting element through the cartridge surface. It is likewise conceivable to color the cartridge surface dark and the connecting element bright, so that the recess, in this case, likewise appears dark in the connecting element because of the cartridge surface.

In accordance with one additional preferred exemplary embodiment, the connecting element is, in a similar design of the cartridge and of the closure element, designed as a band that can be torn off, which [connecting element] encompasses the closure element and/or areas of the ring of the cartridge. The connecting element is thereby welded with the ring of the cartridge in a circular or punctiform manner or is molded onto the same. After the removal of the tear-off band, either a ring of the connecting element or the connecting points remain on the cartridge, particularly on the free end of the ring facing away from the containers.

As an alternative to this, in a two-part configuration of the closure element, one of the two components, preferably a component not rotatable relative to the cartridge with pins engaging in the outlets of the container, can be connected directly with the cartridge, such as the ring of the cartridge, for example. The connection with the cartridge can, for example, be carried out by means of punctiform welding, so that, after the removal of the closure element, corresponding contact points, which indicate the opening of the closure, remain on the cartridge.

In accordance with one additional preferred exemplary embodiment, the connecting element is configured in a similar design of the cartridge and of the closure element as a component encompassing the closure element, at least in areas, which [component] is connected with the ring of the cartridge in a firmly bonded or positively locking manner. This can comprise a cap-like design of the connecting element or a design with several arms that encompasses the closure element.

In accordance with one additional exemplary embodiment of the disclosure, a bar serving as a connecting element is designed on the cartridge, particularly on the ring of the cartridge, which [bar] projects over the free edge of the ring of the cartridge. This bar can then be connected with the closure element in a firmly bonded or positively locking manner.

In accordance with one additional preferred exemplary embodiment, the corresponding accessory has a guide element that engages in a corresponding guide channel of the cartridge. This guide element of the corresponding accessory can, for example, be a positioning tongue, as described in WO 2013/026 721 A1. The closure element can also be equipped with a corresponding guide element that engages in a corresponding channel of the cartridge. In this case, this guide element can serve as a connecting element in the sense of the present disclosure. The guide element of the closure element is thereby preferably provided with a predetermined breaking point and is axially sheared off or removed, upon the first-time removal of the closure element from the cartridge at the predetermined breaking point, so that at least one part of the guide element remains in the guide channel of the cartridge.

BRIEF DESCRIPTION OF THE FIGURES

The disclosure will be illustrated in further detail in the following by means of exemplary embodiments and with reference to the diagrams. All features described and/or graphically depicted thereby form, either by themselves or in any desired combination, the object of the disclosure, independently of their summary in the claims or the retroactive applications of the same.

The following are schematically depicted.

DETAILED DESCRIPTION

Figure 1:
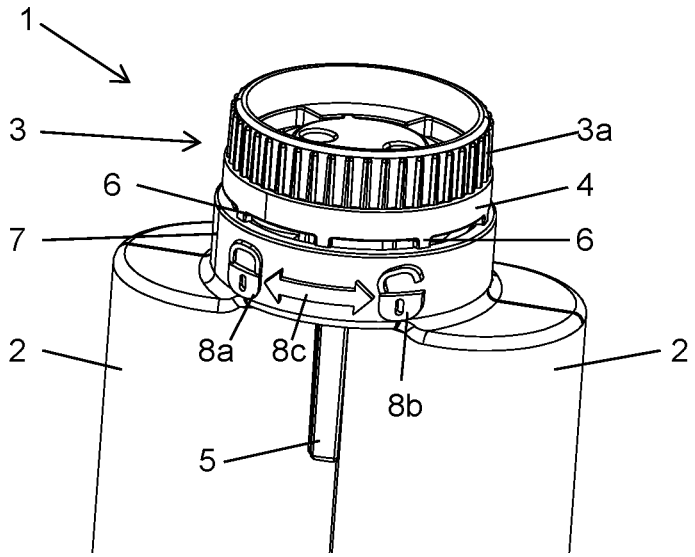
FIGS. 1, 2, 3 and 4 show a first embodiment of an application system in accordance with the disclosure, FIGS. 5, 6, 7 and 8 who a second embodiment of an application system in accordance with the disclosure.

FIG. 1 shows a first embodiment in the storage state with a sealed cartridge 1 with two containers 2. The cartridge 1 is shown here in a storage state and is sealingly closed by a closure element 3, here a closure plug. The closure element 3 comprises a connecting element 4, which is already attached to the closure element 3 in the delivery state and has a positioning tongue 5, the function of which is explained in greater detail in WO 2013/026 717 A1 and is referenced in this connection. Furthermore, the closure element 3 has a circumferential ring 3*a* provided with a corrugated surface, which facilitates a manual twisting of the closure element 3 relative to the cartridge 1.

Several predetermined breaking points 6 are provided on the connecting element 4, by means of which the connecting element 4 is connected with the cartridge 1 in such a way that it cannot be removed without being destroyed. Stated more precisely, the connecting element 4 is connected with the front surface of a collar-shaped connecting part 7 of the cartridge 1 by way of the predetermined breaking points 6. The connecting part 7 serves for the accommodation of a closure element 3 or of a corresponding accessory 11 and has, furthermore, the symbols 8*a*, 8*b* and 8*c*, which indicate the direction of rotation (arrow 8*c*) for the opening (opened lock 8*b*) and for the closing (closed lock 8*a*).

In one preferred configuration, the connecting element 4 and the positioning tongue 5 have the same coding, such as the same color, for example. A specific symbol on the connecting element 4 and the positioning tongue 5 is also conceivable.

Figure 2:
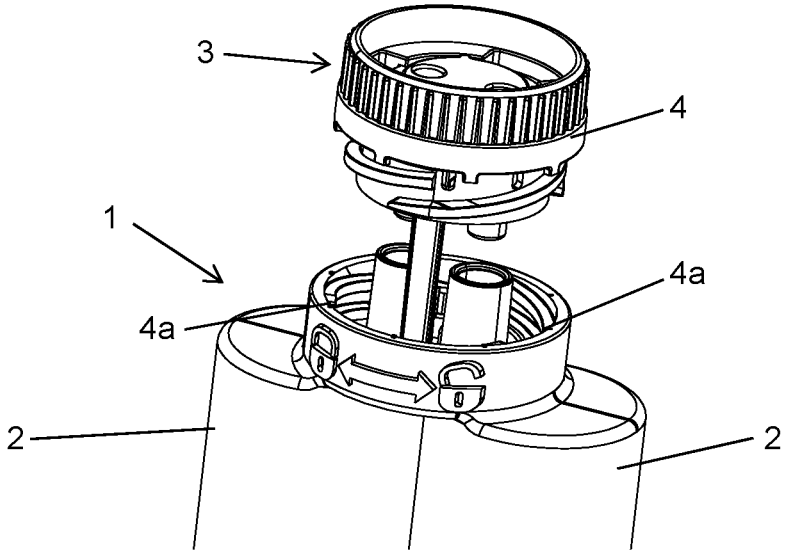

FIG. 2 shows how the closure element 3 is detached from the cartridge 1. While the bulk of the connecting element 4 remains on the closure element 3, connecting points 4*a* were detached at the predetermined breaking points 6, which [connecting points] remain on the cartridge 1 or the front surface of a collar-shaped connecting part 7, respectively. These connecting points 4*a* preferably have a coding in the form of a color, which preferably stands out in clear contrast to the cartridge color.

If the connecting points 4*a* and the connecting element 4 have the same coding, then a user can, even after the detachment of the closure element 3 from the cartridge 1, determine, both rapidly and free of doubt, which closure element 3 sealingly closes the cartridge 1. A user can thus be prevented from placing a non-fitting closure element 3 on the cartridge 1, which would impair the tightness of the closure. Through the sealing of the cartridge 1 with another closure element 3, a contamination of the components stored in the cartridge 1 is additionally prevented.

Figure 3:
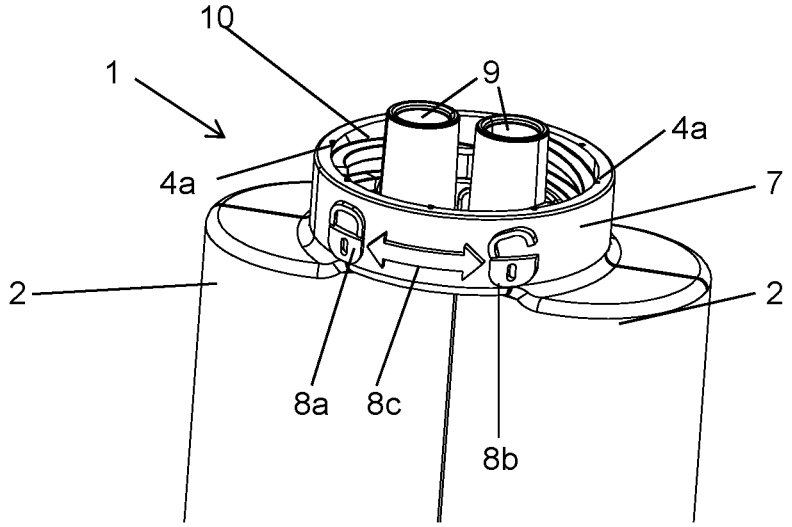

FIG. 3 shows the cartridge 1 in accordance with FIG. 2 without a closure element 3. The precise configuration of the collar-shaped connecting part 7, which encloses the outlets 9 of the container 2 and has an internal thread 10, can be seen in this figure.

Figure 4:
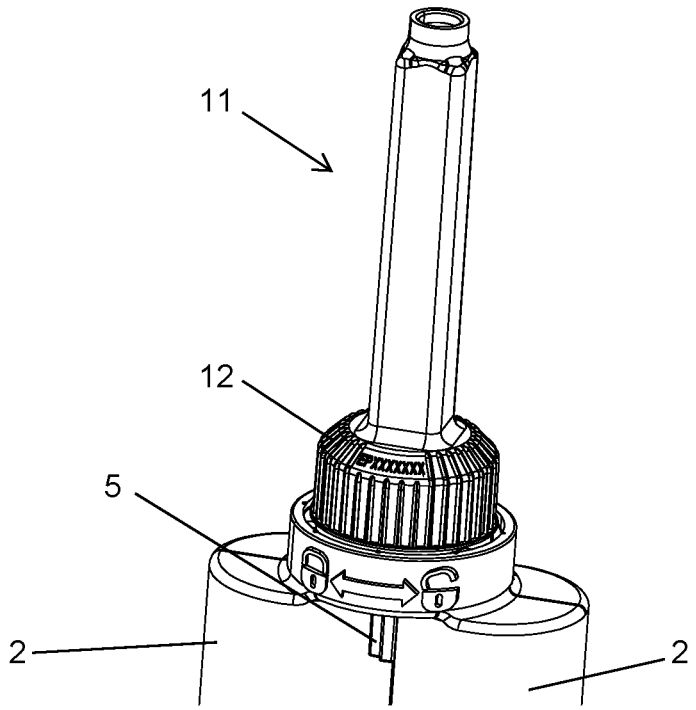

FIG. 4 shows the cartridge 1 as described above with the corresponding accessory 11, here a mixer, in its placed-on position. The mixer 11 comprises, like the closure element 3, a positioning tongue 5, which has the same coding, particularly the same color, as the connecting element 4 and the connecting points 4*a*. By that means, it is particularly simple for a user to place the fitting mixer 11 on the cartridge 1, so that errors in application are avoided. The coding can also, additionally or alternatively, be applied to the accessory housing 12 or to the mixing element (not depicted), to the mixer connecting part, and/or to a union nut, and even bear a symbol that permits a coordination of the fitting parts of the application system instead of a color.

Figure 5:
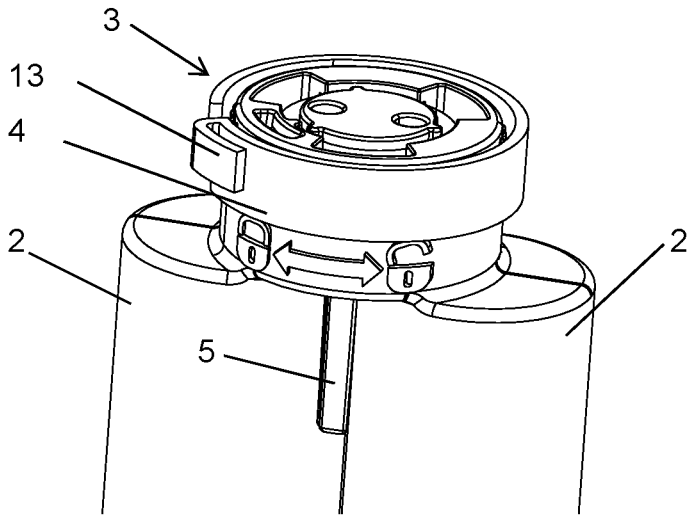

FIG. 5 shows a second configuration of an application system in the storage state with a sealed cartridge 1. The closure element 3 here comprises a connecting element 3 configured as a band that can be torn off with a flexible tab 13, which increases the engagement surface for a manual removal of the connecting element 4 configured as a band from the closure element 3 and thus represents a particularly user-friendly configuration. It is preferred if the connecting element 4 and the positioning tongue 5 configured as a band have the same coding, particularly the same color. The coding can also be applied, additionally or alternatively, to the accessory housing 12 or to the mixing element (not depicted), to the mixer connecting part, and/or to a union nut, and even bear a symbol that permits a coordination of the fitting parts of the application system instead of a color. In the variant depicted here, it is necessary to remove the connecting element 4 configured as a band from the cartridge 1 before the detachment of the closure element 3.

Figure 6:
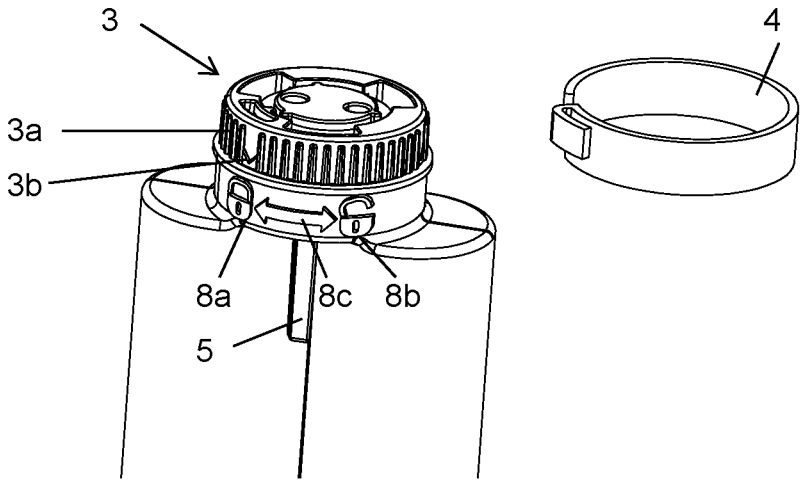

A band 13 detached from the closure element 3 is depicted in FIG. 6. In this state, the closure element 3 is detachable from the cartridge 1 through the relative rotation of the closure element 3 relative to the cartridge 1. The corrugated ring 3*a* is released through the detachment of the band 13, and a user can remove the closure element 3 through rotation relative to the cartridge 1. A marking 3*b* is preferably provided on the ring 3*a* which, in the interaction with the symbols 8*a* and 8*b*, indicates a sealed cartridge 1 (symbol 8*a*) or an opened cartridge 1 (symbol 8*b*).

Figure 7:
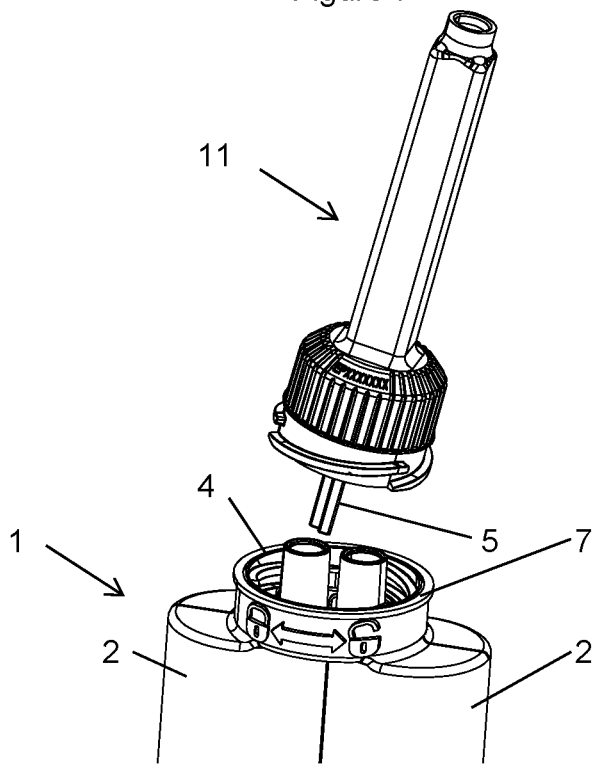

FIG. 7 shows an additional configuration of a coding over a portion of the connecting element 4, which remains on the cartridge 1 upon the detachment of the closure element 3. The connecting element 4 is constructed in the embodiment depicted in FIG. 7 as a circumferential ring on the internal edge of the collar-shaped connecting part 7. The coding is preferably achieved by a corresponding color of the connecting element 4 and of the positioning tongue 5. Since the connecting element 4 is, in the second configuration, positioned on the side of the closure element 3 facing the cartridge 1, this cannot be seen in FIGS. 5 and 6. On the other hand, the coding can also be applied, either additionally or alternatively, to the accessory housing 12 or to the mixing element (not depicted), to the mixer connecting part, and/or a union nut and even bear a symbol that permits a coordination of the fitting parts of the application system instead of a color.

Figure 8:
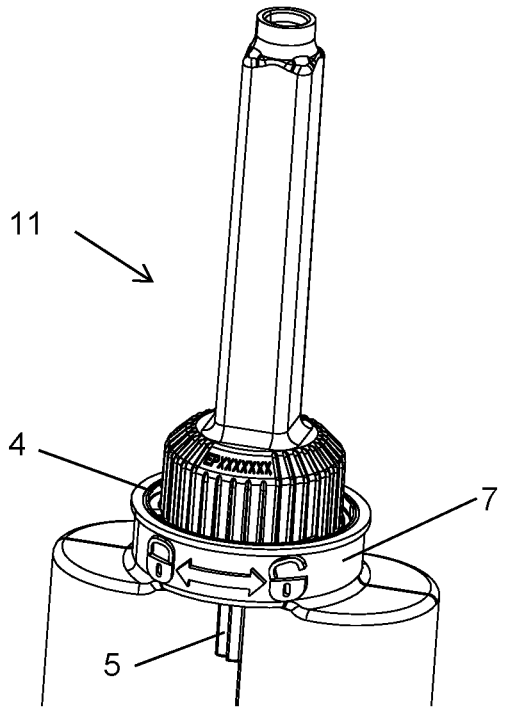

FIG. 8 illustrates the system in accordance with FIG. 7 with the mixer 11 placed on. The connecting element 4 can also be seen in this state, so that the coding can be seen, even after the placement of a corresponding accessory 11 on the cartridge 1. By that means, it can be checked, even when the corresponding accessory 11 has already been placed on, whether the codings of the cartridge 1 and the accessory 11 are in agreement, which can, in this case, particularly involve the corresponding color of the connecting element 4 and of the positioning tongue 5.

Figure 9:
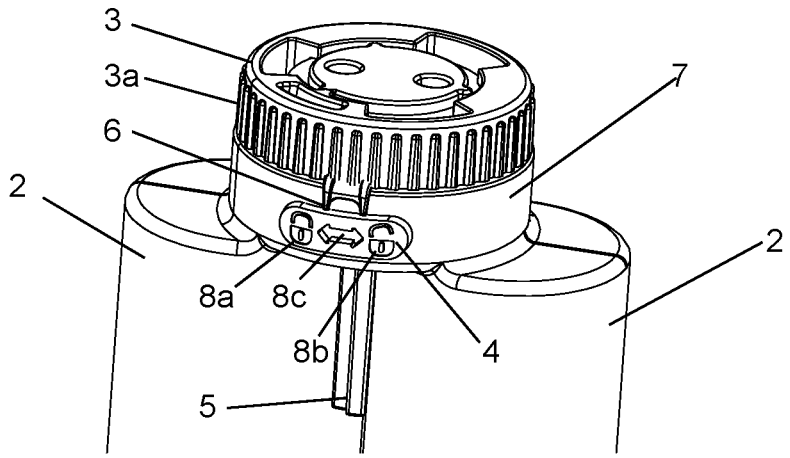
FIGS. 9, 10, 11 and 12 show a third embodiment of an application system in accordance with the disclosure.

FIG. 9 shows a third configuration of a storage state of the application system. In this case, the connecting element 4 is connected with the ring 3*a* of the closure element 3 by way of predetermined breaking points 6. The symbols 8*a*, 8*b* and 8*c* previously attached to the cartridge 1 are now implemented as recesses in the connecting element 4. The symbols 8*a*, 8*b* and 8*c*, the surface of the cartridge 1 or of its connecting part 7, respectively, can be seen through the recesses forming. The connecting element 4 is, furthermore, attached to the connecting part 7 of the cartridge 1, such as by fusing, for example.

Figure 10:
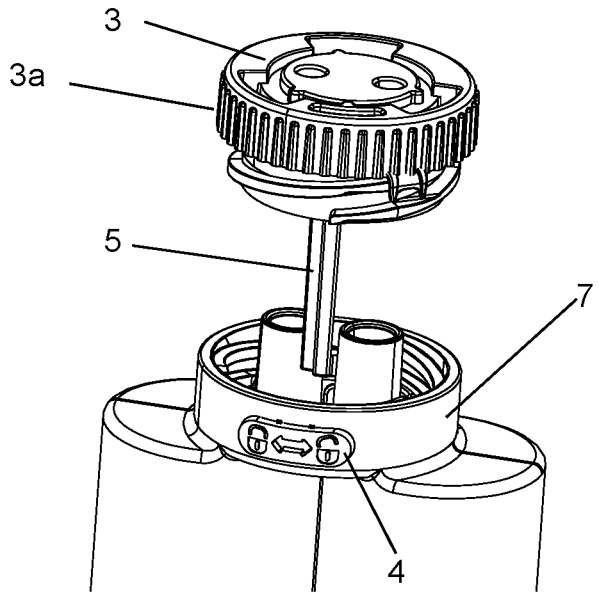

FIG. 10 shows the configuration in accordance with FIG. 9 after the detachment of the closure element 3 from the cartridge 1. The connecting element 4 remains with one part on the cartridge 1 and is sheared off from the closure element 3 at the predetermined breaking points 6. In particular, the connecting element 4 and the positioning tongue 5 have this color, which permits a coding and thereby an assignment of fitting parts of the application system. On the other hand, the coding can also be applied, additionally or alternatively, to the accessory housing 12 or to the mixing element (not depicted), to the mixer connecting part, and/or to a union nut, and even bear a symbol that permits a coordination of the fitting parts of the application system instead of a color.

Figure 11:
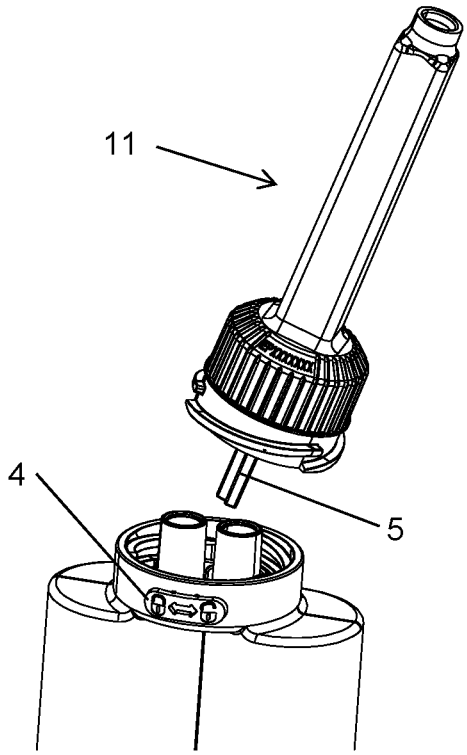

FIG. 11 illustrates a connecting or placement of a corresponding accessory 11 with the cartridge 1 and connecting element 4 attached to it. A coding is achieved through an agreement in the color of the positioning tongue 5 and the connecting element 4.

Figure 12:
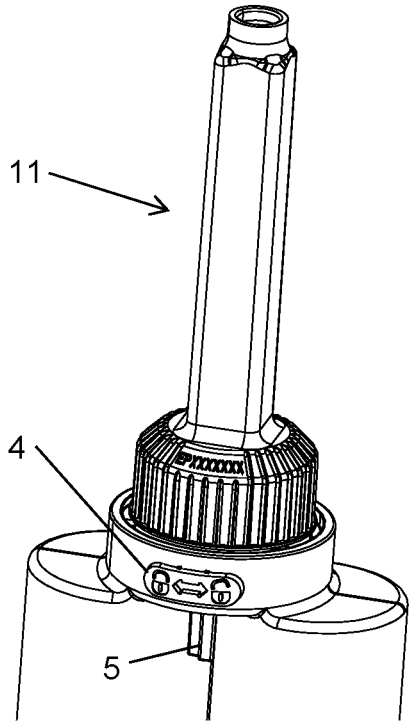

FIG. 12 shows the embodiment in accordance with FIG. 11 with the corresponding accessory 11 completely placed on. Since both the positioning tongue 5 as well as the connecting element 4 can be seen in a corresponding accessory 11 connected with the cartridge, a check can be performed in order to determine whether a fitting corresponding accessory 11 has been placed on, whereby application errors are avoided.

Figure 13:
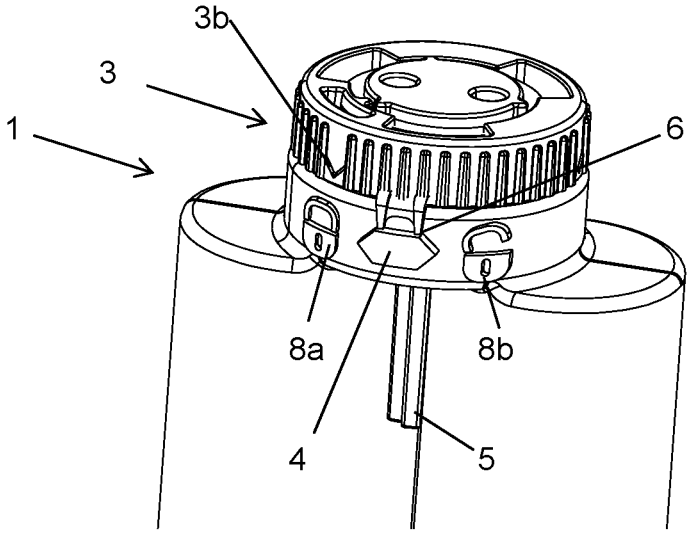
FIGS. 13, 14, 15 and 16 show a fourth embodiment of an application system in accordance with the disclosure.

FIG. 13 shows a fourth embodiment of an application system in the storage state with a sealed cartridge 1. The connecting element 4 is configured hexagonally here and is connected with the closure element 3 by way of predetermined breaking points 6. On the other hand, both the positioning tongue 5 as well as the connecting element 4 can be of the same color, which permits a coordination of the fitting elements of the application system. On the other hand, the coding can also be applied, additionally or alternatively, to the accessory housing 12 or to the mixing element (not depicted), to the mixer connecting part, and/or to a union nut, and even bear a symbol that permits a coordination of the fitting parts of the application system instead of a color.

Figure 14:
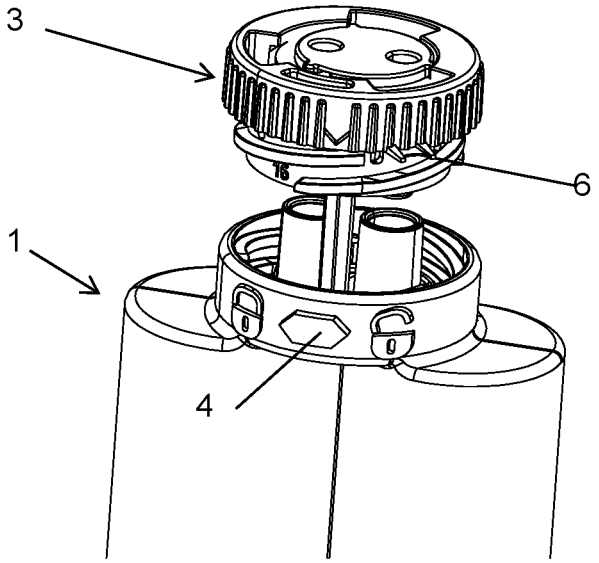

In the fourth embodiment, if the closure element 3 is detached from the cartridge 1, the connecting element 4 breaks off from the closure element 3 at the predetermined breaking points 6 and remains on the cartridge 1, as can be seen in FIG. 14.

Figure 15:
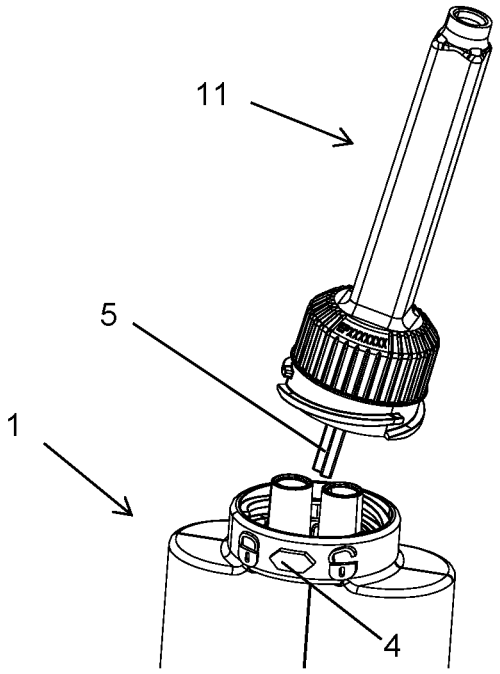
Figure 16:
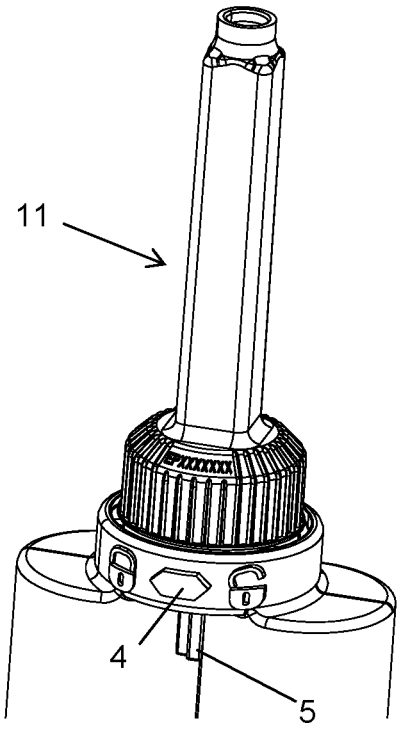

FIG. 15 and FIG. 16 show the connecting of a corresponding accessory 11 and, on the other hand, a mixer, with the cartridge 1 (FIG. 15), as well as the placed-on state (FIG. 16). For that purpose, the closure element 3 is detached from the cartridge, so that it can be used in a state of use, such as to dispense the components stored in it, for example. In order for a user to be able to assign the fitting accessory 11 to the cartridge 1, the positioning tongue 5 and the connecting element 4 are configured with the same coding, particularly of the same color.

Figure 17:
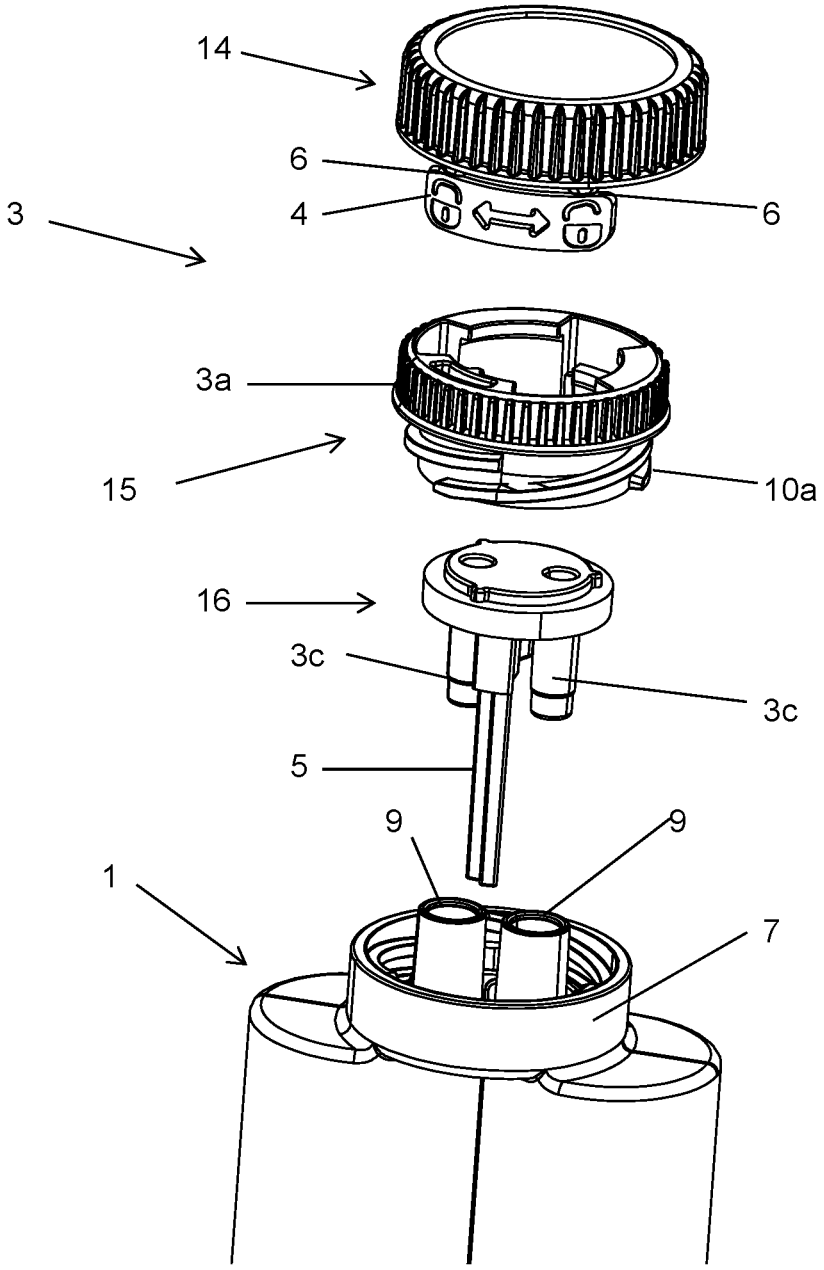
FIGS. 17, 18, 19, 20 and 21 show a fifth embodiment of an application system in accordance with the disclosure.

FIG. 17 shows an exploded diagram of an application system in accordance with a fifth embodiment.

In this embodiment, the closure element 3 is configured in a three-part manner and comprises a union element 14, here a cap, a fastening ring 15, and a closure insert 16. The fastening ring 15 comprises an external thread 10*a*, which can engage with the internal thread of the connecting part 7 of the cartridge 1 and can create a connection between the closure element 3 and the cartridge 1. Bearing pins 3*c*, which can be plugged into the outlets 9 of the container 2 of the cartridge 1 and thus sealingly close the same, are provided on the closure insert 16.

While the closure elements 3 of the first four embodiments of the application system similarly have a fastening ring 15 and a closure insert 16, the closure plugs, particularly those shown in FIG. 17, additionally have a union element 14.

Figure 18:
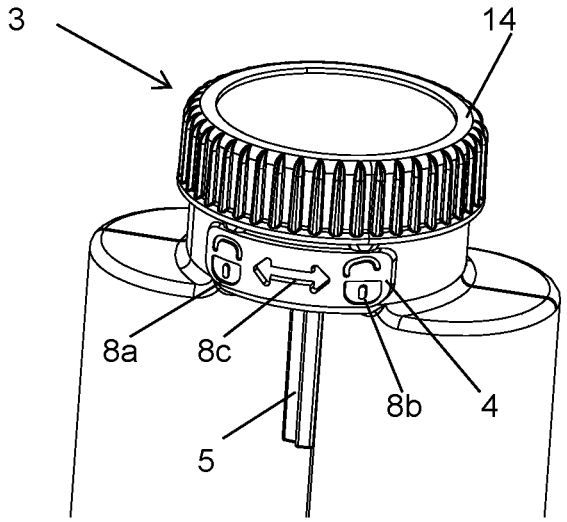
Figure 19:
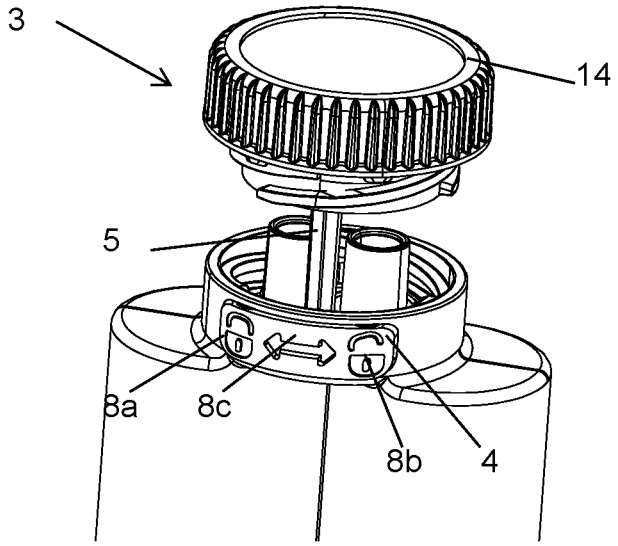

The union element 14 here is connected with the connecting element 4 by way of predetermined breaking points 6 and can be pulled over a fastening ring 15 of the closure element 3, as indicated in FIG. 17 and as occurs in FIGS. 18 and 19. By that means, the closure elements 3, which are present and known per se, can be used and supplemented in order to produce a separately producible union element 14 and to thus form parts of the application system in accordance with the disclosure. In other words, through the provision of the union element 14, an existing application system can be easily configured in accordance with the disclosure and improved.

The connecting element 4 of the fifth embodiment is, similarly to the case in the third embodiment in accordance with FIGS. 9 to 12, provided with recesses, which form the symbols 8*a*, 8*b* and 8*c* (FIG. 18). The assembly in accordance with FIG. 18 represents a possible storage state.

The application system in accordance with FIG. 17 therefore shows one possible delivery state of an application system in accordance with the disclosure before the joining of the union element 14, closure element 3 and cartridge 1.

FIG. 19 shows the detachment of the closure element 3 from the cartridge 1, whereby the connecting element 4 breaks off from the closure element 3 at the predetermined breaking points 6 and remains on the cartridge 1.

Figure 20:
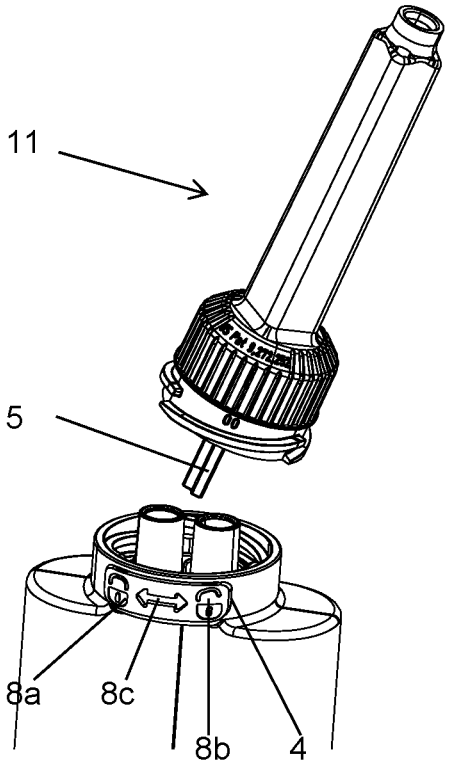
Figure 21:
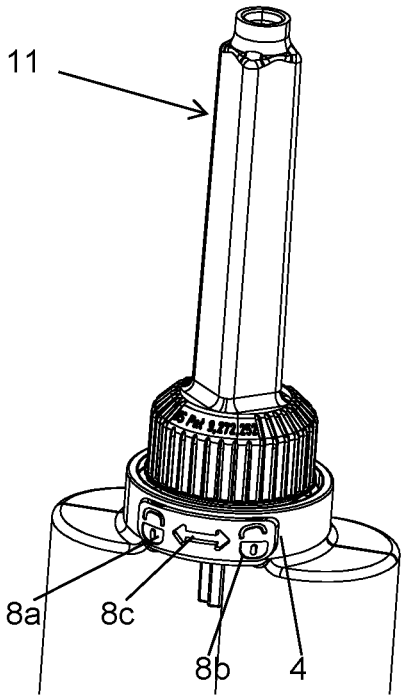

FIG. 20 and FIG. 21 show the placement and the connecting of a corresponding accessory 11 on or with the cartridge 1 (FIG. 20) and the placed-on state (FIG. 21), respectively. The positioning tongue 5 and the connecting element 4 are preferably designed with the same coding, particularly the same color. On the other hand, the coding can also be applied, additionally or alternatively, to the accessory housing 12 or to the mixing element (not depicted), to the mixer connecting part, and/or to a union nut, and even bear a symbol that permits a coordination of the fitting parts of the application system instead of a color.

Figure 22:
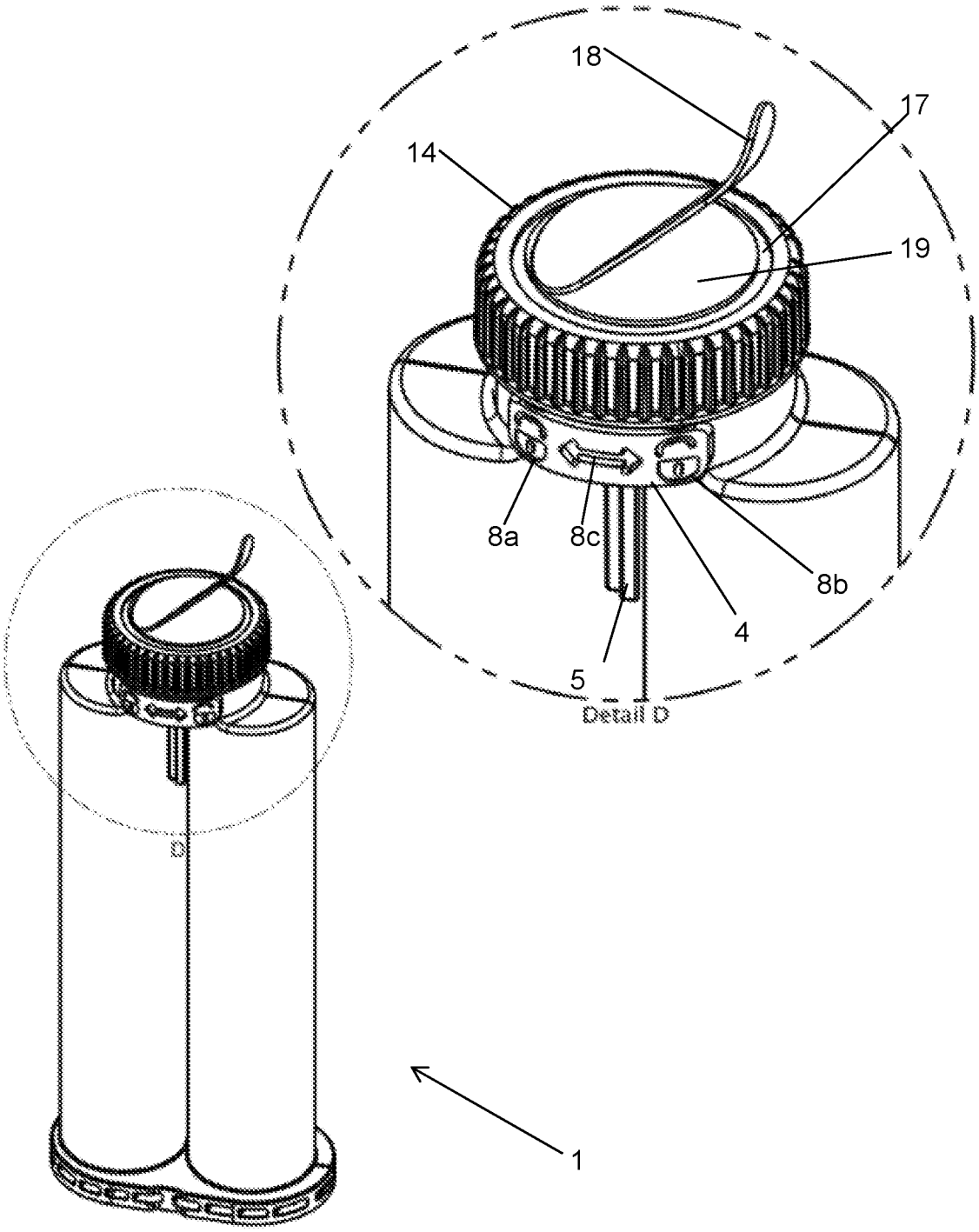
FIG. 22 shows a first variant of the closure element in accordance with the fifth embodiment.
Figure 23:
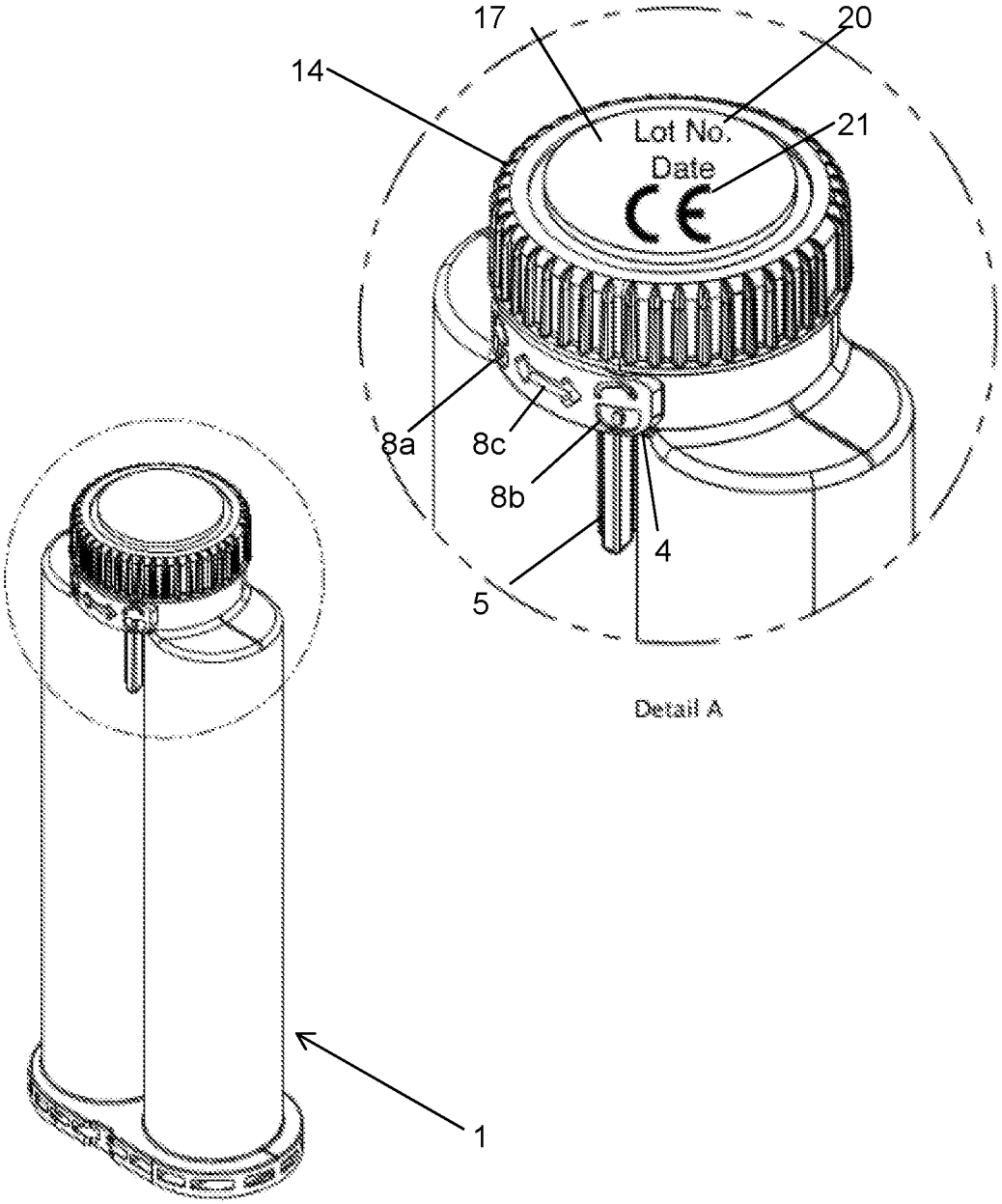
FIG. 23 shows a second variant of the closure element in accordance with the fifth embodiment.

FIGS. 22 and 23 each show a variant of the application system in accordance with the disclosure in accordance with the fifth embodiment, in which a depression 17 is provided in the union element 14.

The depression 17 can, in the variant depicted in FIG. 22, be sealed by a pull tab 18, whereby the pull tab 18 is preferably adhered to the union element 14 on its edges.

A foldable package insert 19, an RFID chip, a transponder, and/or a bonus or payback token or the like can be accommodated in the depression 17, for example. The accommodation of a foldable package insert 19, as depicted here, has the advantage, in particular, that the package insert 19 can contain information on the use of the cartridge 1 in accordance with regulations and/or the contents. But the package insert 19 here is not enclosed in the packaging (not depicted) of the cartridge 1, as is usually the case, but is instead connected with the application system, so that a user can, in the event of unclarity about use, inform himself quickly and without complication. Furthermore, the package insert 19 is readily available, even after the unpacking of the application system and the disposal of the packaging material. A package insert 19 accommodated in the depression 17 is also of importance for a manufacturer of the application system and/or of the components stored therein, in order for the same to comply with the requirements for the provision of verifiable legal information on the application system and/or the components stored therein.

FIG. 23 shows an alternative to FIG. 22, in which, instead of a package insert 19, the recess 17 is used to present production-specific information 20 and/or test seal 21.

Figure 24:
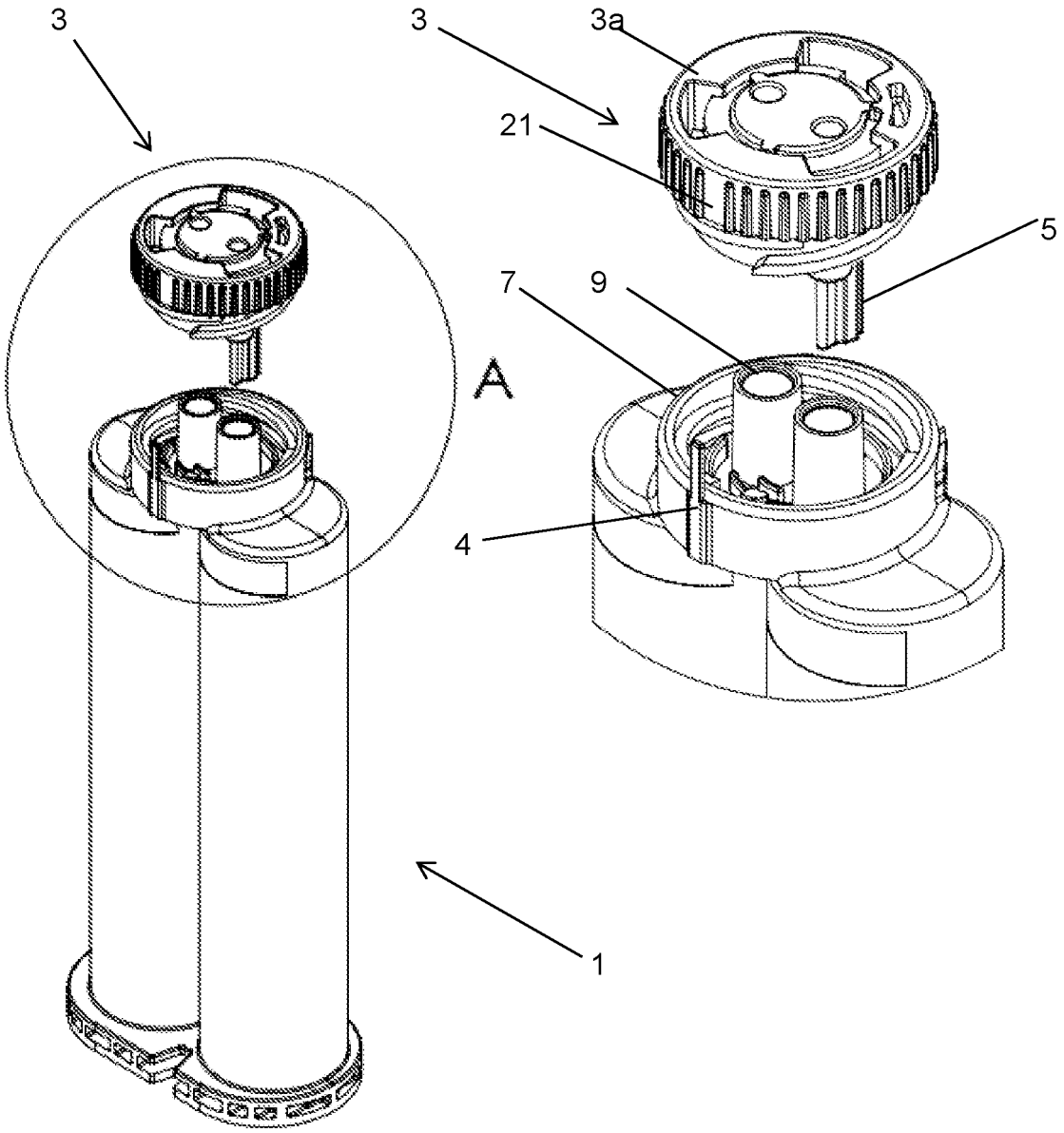
FIG. 24 shows a sixth embodiment of an application system in accordance with the disclosure.
Figure 25:
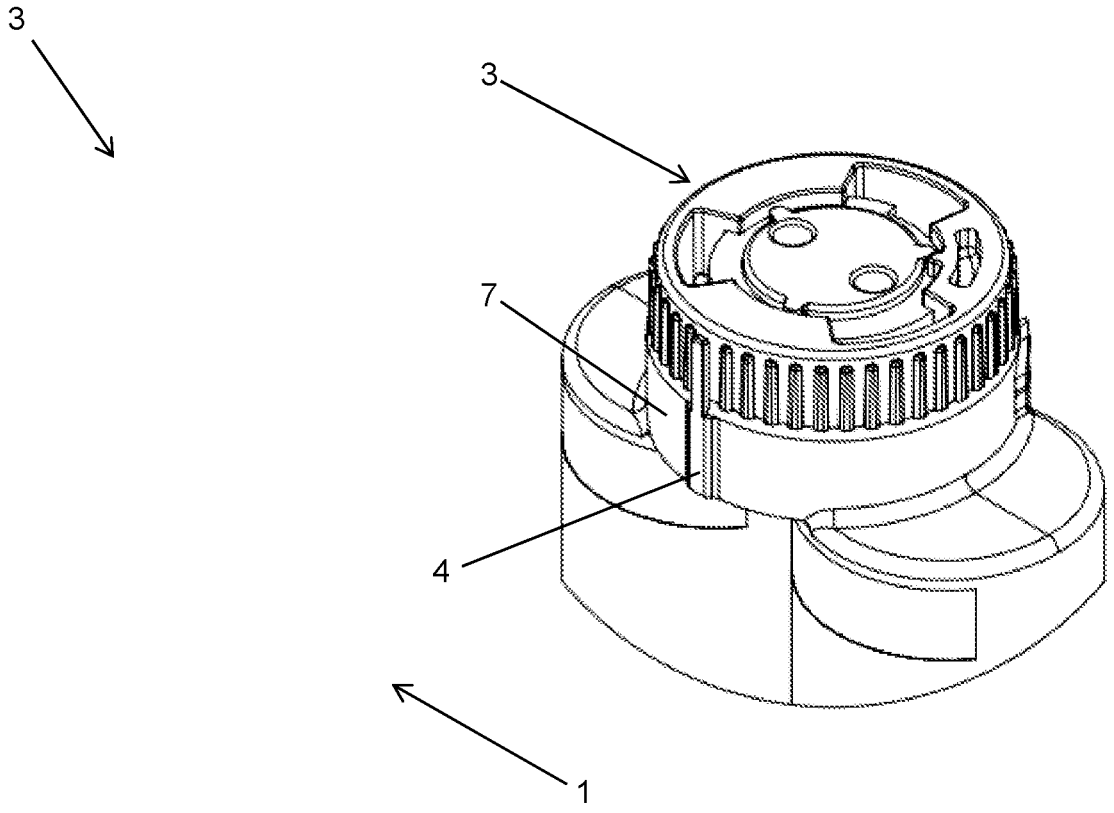
FIG. 25 shows the sixth embodiment, whereby the closure element is connected with the cartridge.

FIG. 24 shows a sixth embodiment of the application system in accordance with the disclosure. The connecting element 4 here is designed in a single piece with the cartridge 1 as a bar protruding over the connecting part 7. This bar can be accommodated on the closure element 3 by means of a latching recess 22 provided on the ring 3*a*, if the closure element 3 is connected with the cartridge 3 (FIG. 25). The latching recess 22 is designed here through the omission of a groove on the external edge of the ring 3*a*.

FIG. 25 shows the sixth embodiment of the application system in accordance with the disclosure, whereby the closure element 3 is connected with the cartridge 1. In particular, it can be seen in the detailed view that the connecting element 4 constructed as a bar is accommodated in the recess 22. If the closure element 3 detaches from this through rotation relative to the cartridge 1, then a shearing off of the connecting element 4 constructed as a bar comes about, so that a first-time opening of the cartridge 1 can be seen. Since the part of the connecting element 4 positioned higher than the connecting part 7 remains on the cartridge 1, however, a coordination of fitting accessories 11 is possible, even after the detachment of the closure element 3.

Figure 26:
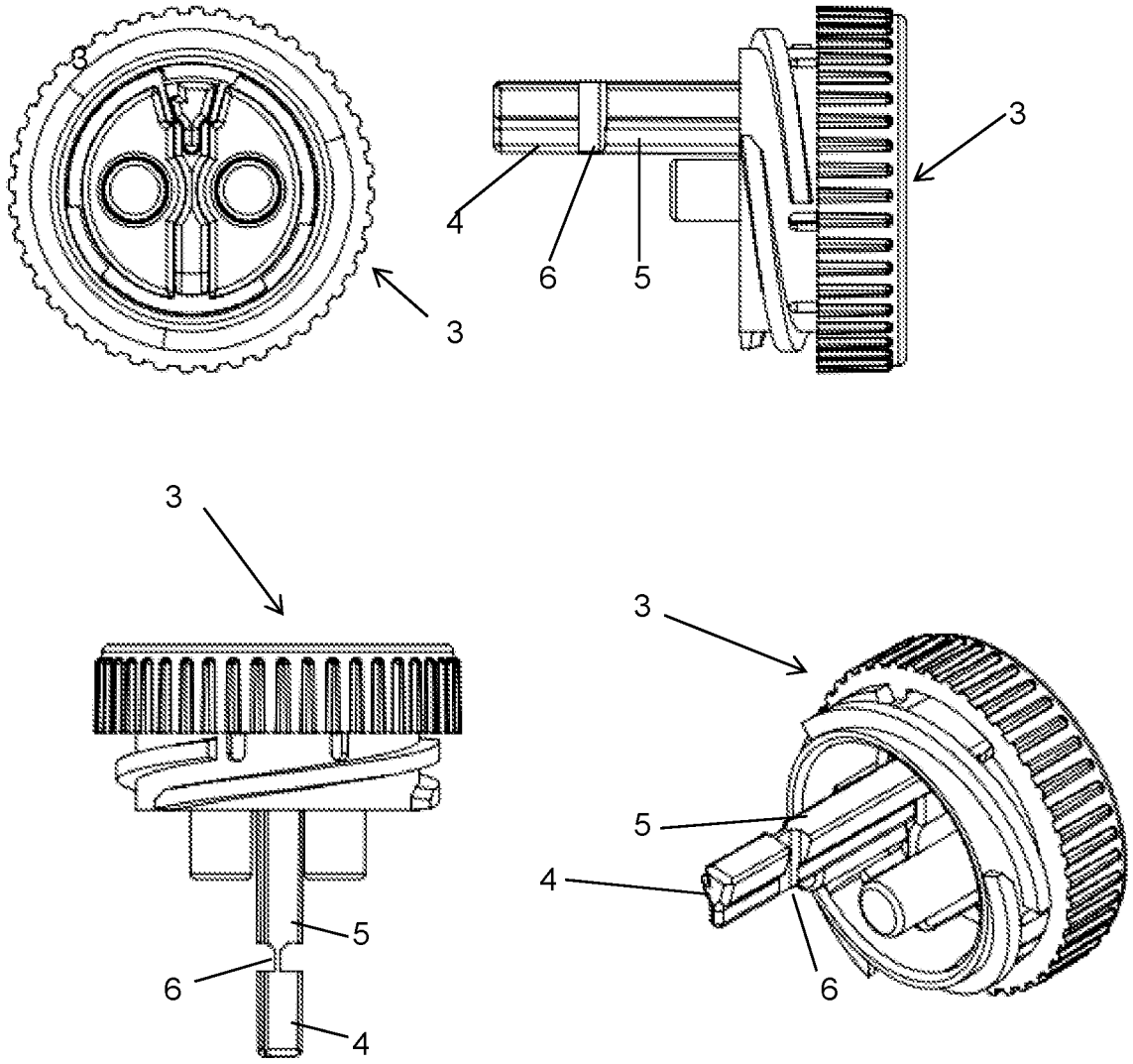
FIG. 26 shows a closure element of a seventh embodiment of an application system in accordance with the disclosure.

FIG. 26 shows a closure element 3 of a seventh embodiment of an application system in accordance with the disclosure. In comparison with the above-described configurations of the closure element 3, the connecting element 4 is configured as a guide element and is connected with the positioning tongue 5 by way of a predetermined breaking point 6.

Figure 27:
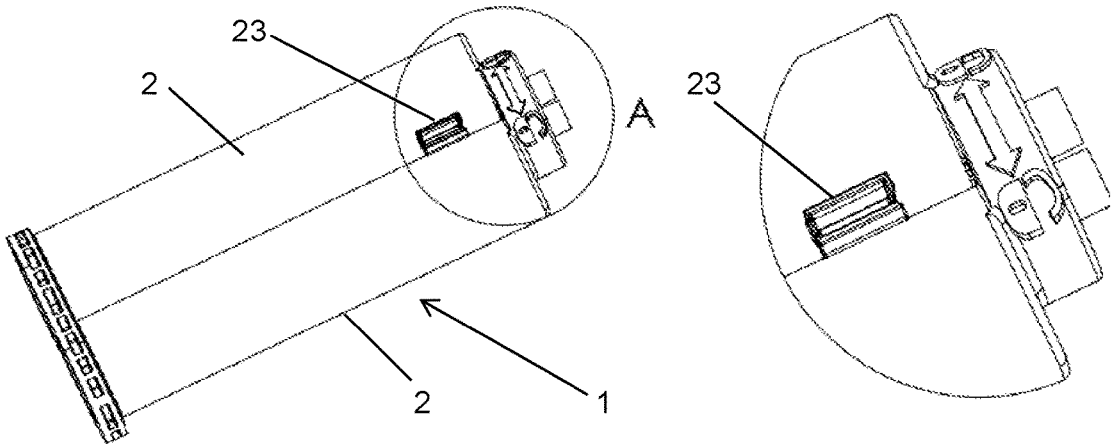
FIG. 27 shows a cartridge of a seventh embodiment of an application system in accordance with the disclosure.

FIG. 27 shows a cartridge 1 of a seventh embodiment of an application system in accordance with the disclosure. A guide channel 23, which can accommodate the connecting element 4 configured as a guide element (FIG. 28) and is, in particular, axially secured by engagement in the guide channel 23, is provided between the containers 2.

Figure 28:
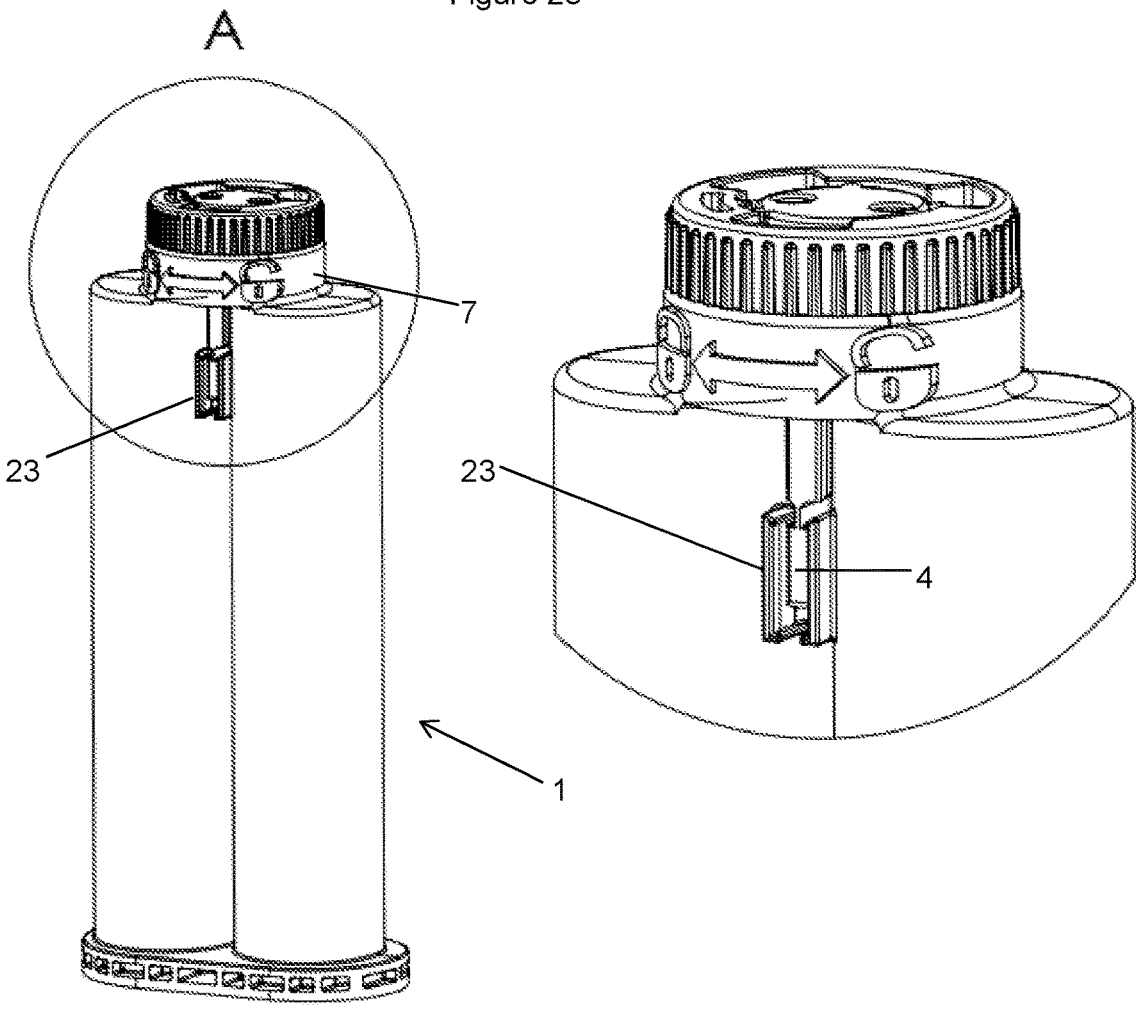
FIG. 28 shows the seventh embodiment, whereby the closure element is connected with the cartridge.

In FIG. 28, the closure element 3 in accordance with FIG. 26 is connected with the cartridge 1 in accordance with FIG. 27, so that an application system in accordance with the seventh embodiment is obtained. In particular, it can be seen in the detailed view that the guide channel 23 and the connecting element 4 configured as a guide element are thus adjusted to one another, so that the guide channel 23 accommodates the connecting element 4 and the predetermined breaking point 6 is positioned with the end of the guide channel 23 lying in the direction of the connecting part 7 at an axial level.

If the closure element 3 is detached from the cartridge 1 by relative twisting, then a breaking of the predetermined breaking point 6 comes about due to the forces acting axially on it. The connecting element 4 is thereby detached from the closure element 3, through which a first-time opening of the cartridge 1 becomes visible.

Figure 29:
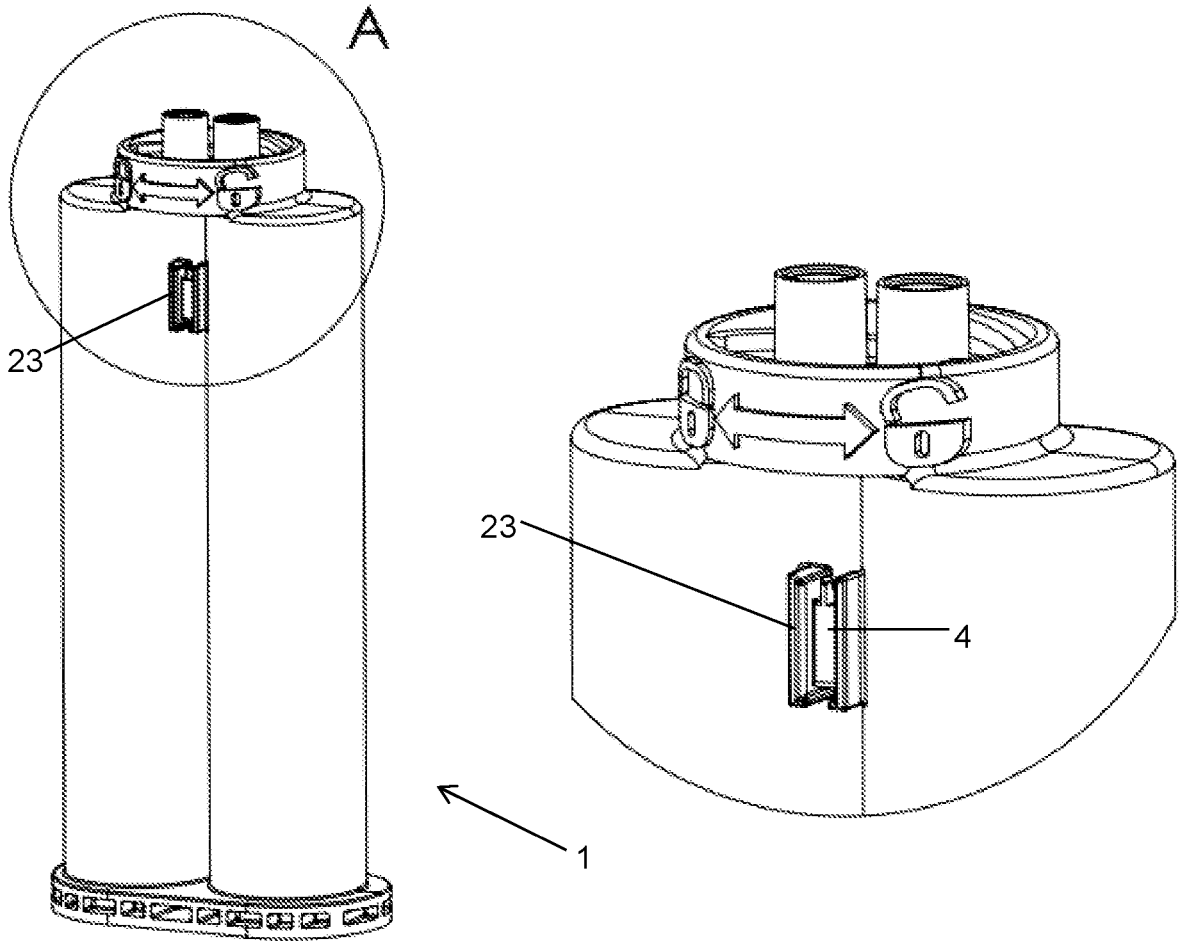
FIG. 29 shows the seventh embodiment, whereby the closure element has been detached from the cartridge.

The connecting element 4 remains in the guide channel 23 of the cartridge 1, as shown in FIG. 29 and, because of a coding, particularly a color coding, this can indicate a fitting accessory 11. The coding can be applied to the positioning tongue 5 and, additionally or alternatively, to the accessory housing 12 or to the mixing element (not depicted), to the mixer connecting part, and/or to a union nut, and even bear a symbol that permits a coordination of the fitting parts of the application system instead of a color.

Figure 30:
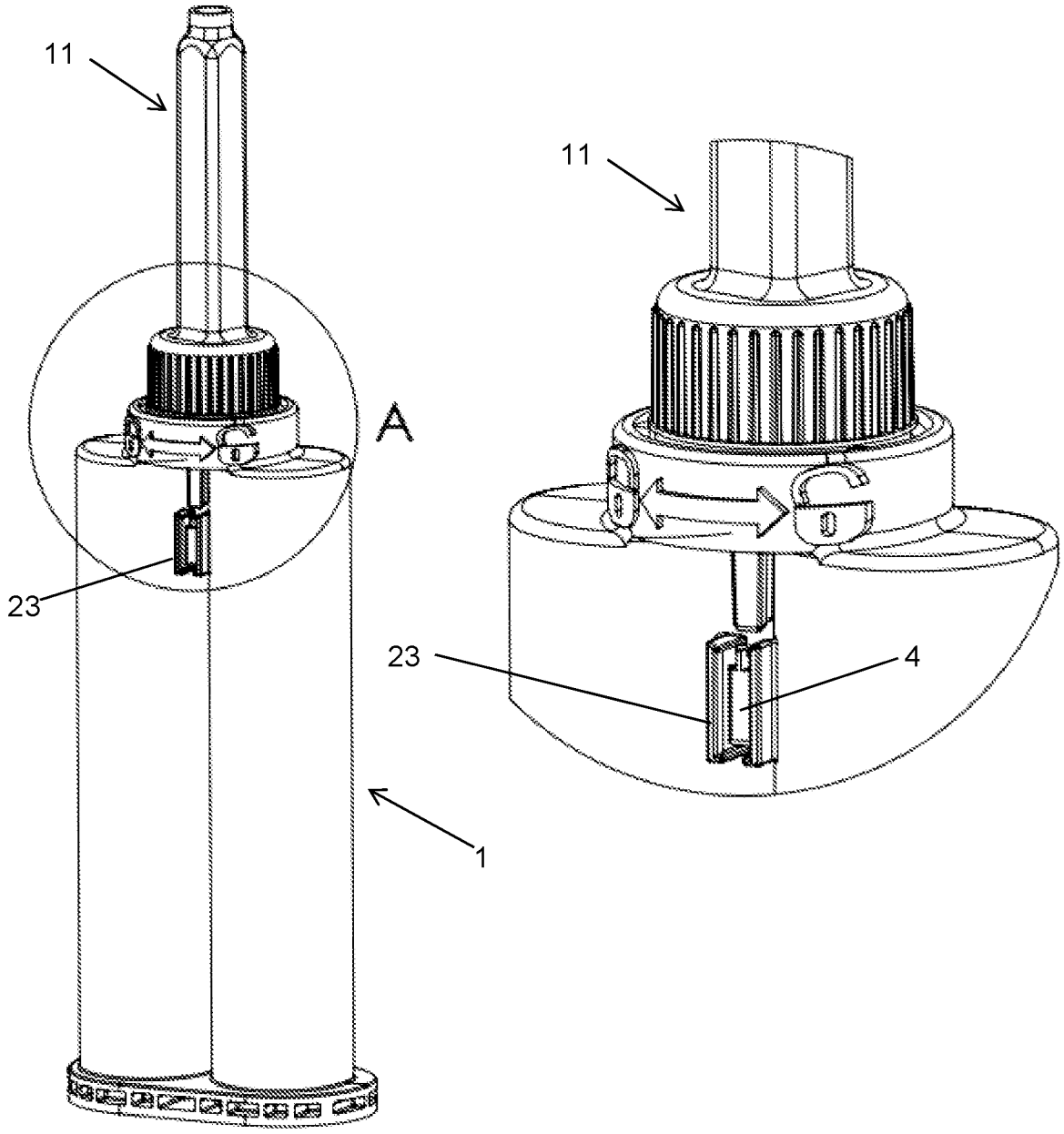
FIG. 30 shows the seventh embodiment in perspective view, whereby an accessory has been connected with the cartridge.

FIG. 30 shows the seventh embodiment, whereby a corresponding accessory 11, here a mixer, is connected with the cartridge 1. It can be seen, in particular, that the guide channel 23 is positioned on the cartridge 1 in such a way that a placement of the corresponding accessory 11 on the cartridge 1 is not prevented. Furthermore, the guide channel 23 and the connecting element 4 accommodated therein, which is detached from the closure element 3, lie with the positioning tongue 5 in a plane between the containers 2. By that means, the codings on the connecting element 4 and on the positioning tongue 5 can easily be checked, even after the placement of the corresponding accessory 11 on the cartridge 1, so that this error can be seen and corrected, even upon the placement of a non-fitting accessory 11.

Figure 31:
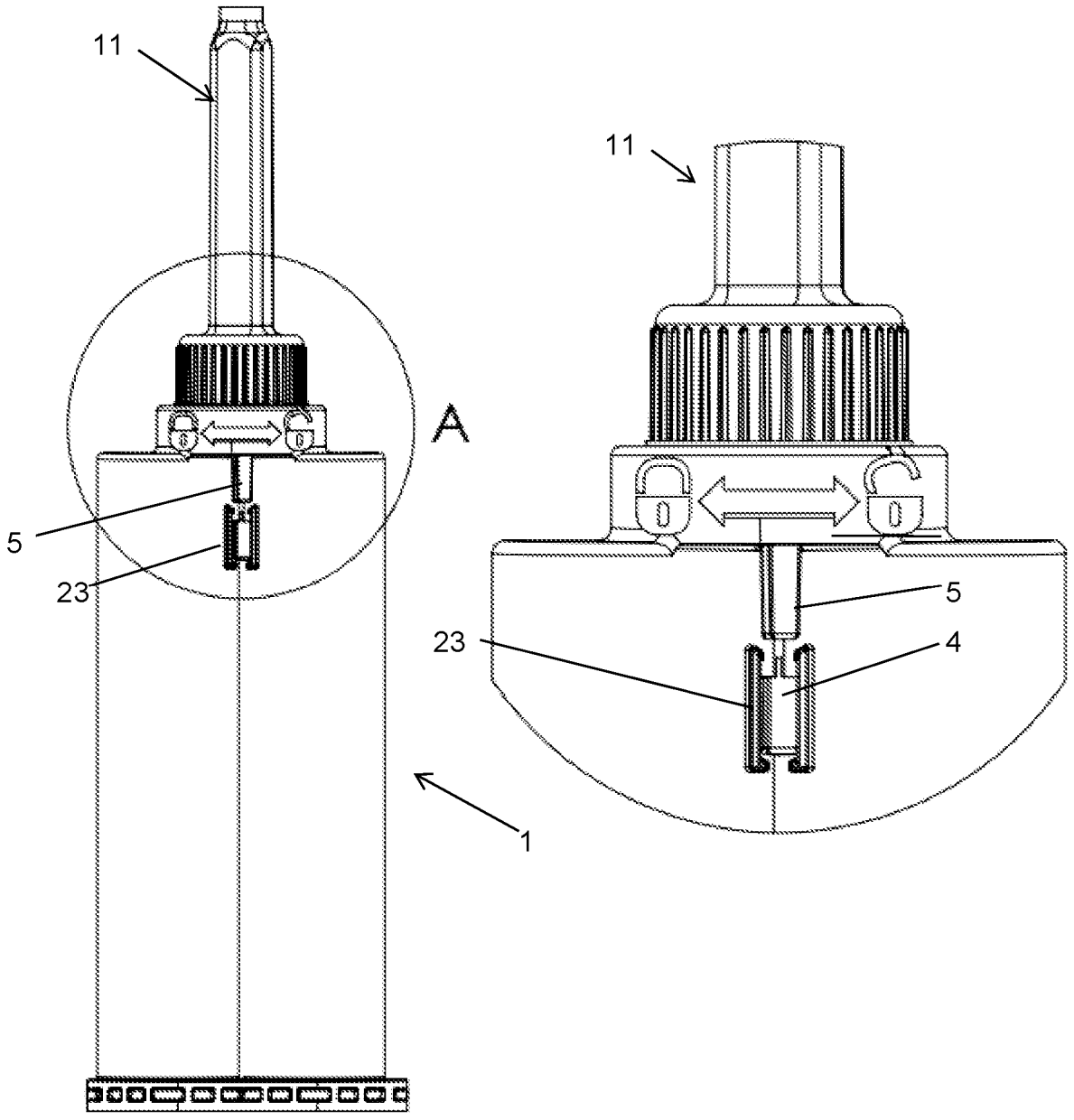
FIG. 31 shows a view of the front view of the seventh embodiment shown in FIG. 30.

FIG. 31 shows a view of the front view of the seventh embodiment shown in FIG. 30. The above-described assembly of detached connecting element 4 and positioning tongue 5 of the corresponding accessory 11 is once again made clear by this.

Figure 32:
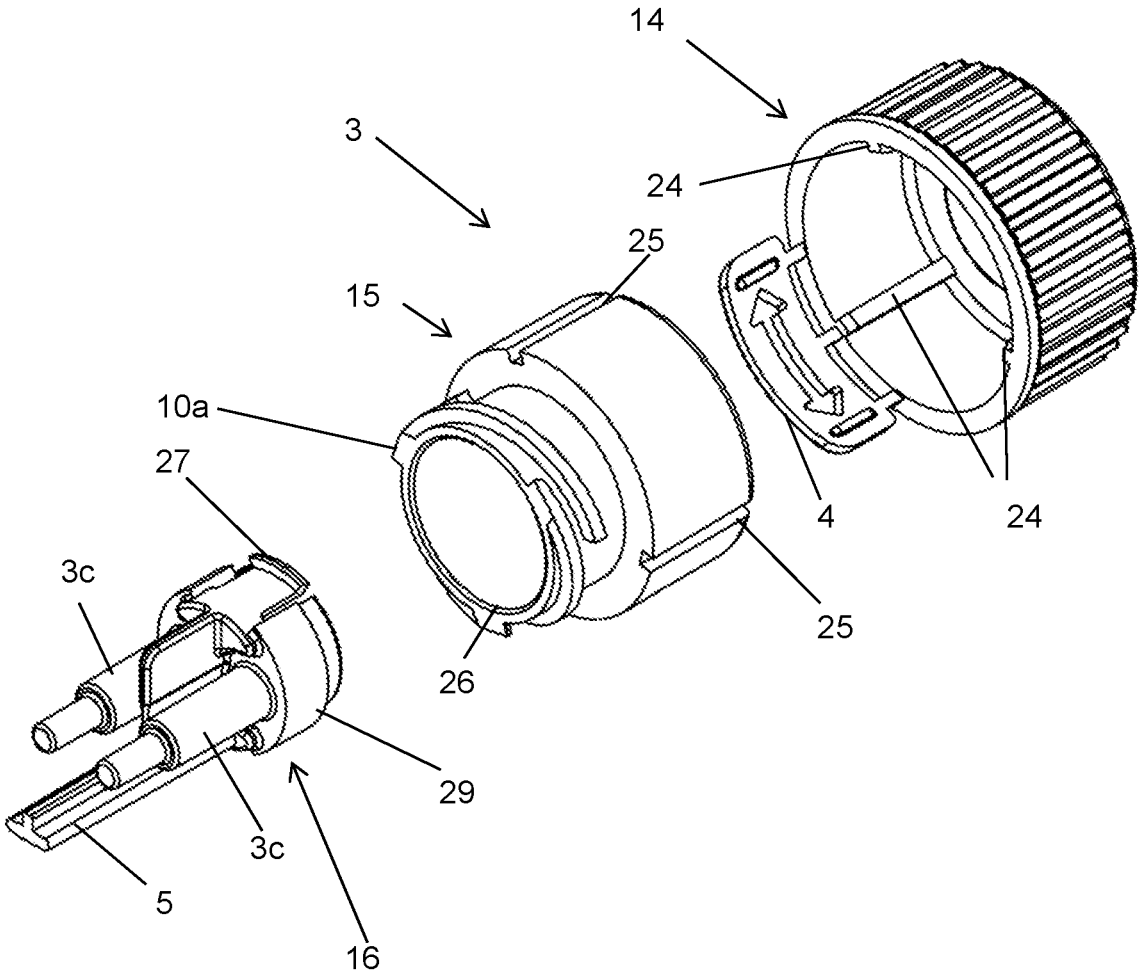
FIG. 32 shows an exploded diagram of an additional closure element.
Figure 33:
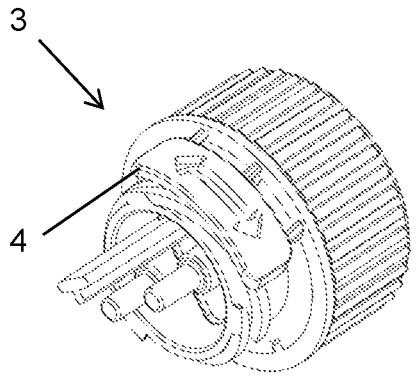
FIG. 33 shows a perspective view of the closure element of FIG. 32.
Figure 34:
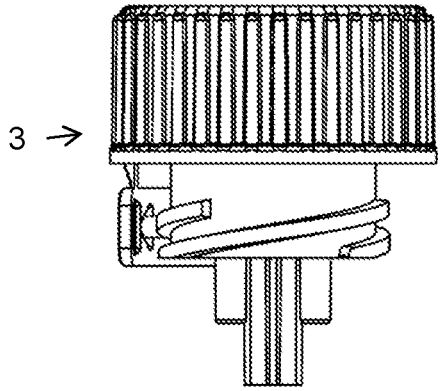
FIG. 34 shows a first lateral view of the closure element of FIG. 32.

FIG. 32 depicts an additional closure element 3 with a union element 14, a fastening ring 15, and a closure insert 16, which [closure element] thereby corresponds to the extent of a closure element 3 as depicted in FIG. 17. Thus, reference is made, in this respect, to the above description and the differences will be explained in the following.

In the embodiment shown in FIG. 32, the union element 14 has several projections 24, which are provided on the inside and are evenly spaced at an interval of 120°, considered radially.

The fastening ring 15 here comprises several grooves 25, which are provided on the exterior of the fastening ring 15 and are, like the projections 24, evenly spaced at an interval of 120°, considered radially. Furthermore, an opening 26 that can accommodate the closure insert 16 is provided. The fastening ring 15 also comprises a circumferential annular projection 28, which is visible in FIGS. 40 and 41.

Furthermore, at least one locking tab 27 is provided on the closure insert 16, which [locking tab] firmly fastens the closure insert 16 to the fastening ring 15 in an axially secured but rotatable manner through the fact that the locking tab 27 engages behind or over the annular projection 28.

Upon the assembly of the closure element 3, the closure insert 16 can first of all be inserted forward with the bearing pin 3*c* and the positioning tongue 5 into the opening 26 of the fastening ring 15. The positioning of the closure insert 16 with the closure element 3 is ensured by the locking tab 27, the circumferential annular projection 28, and the radial contour 29. By that means, an unintended and excessively deep insertion or even pressing through of the closure insert 16 is also prevented. The union element 14 is subsequently pushed over the fastening ring 15, whereby the projections 24 engage in the grooves 25 provided for that purpose and thus fix the union element 14 to the fastening ring 15 in a rotationally secure manner. By that means, a rotational movement of the union element 14 can be transferred to the external thread 10*a*.

The position of the projections 24 and of the grooves 25 are arranged at 120 degrees in relation to the threading position, by which means it is ensured that, upon the insertion of the union elements 14, the connecting element 4 comes to lie in a precise position on the threaded collar 7 and can be fixed there if the closure element 3 is attached to the cartridge 1.

FIGS. 33 to 38 show, in serial sequence, a perspective view, a first lateral view, a view from above, a view from below, a frontal view, and a second lateral view of the closure element 3 of FIG. 32 in assembled form.

Figure 35:
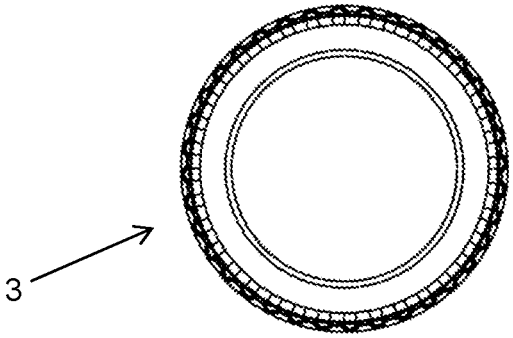
FIG. 35 shows a view from above of the closure element of FIG. 32.
Figure 36:
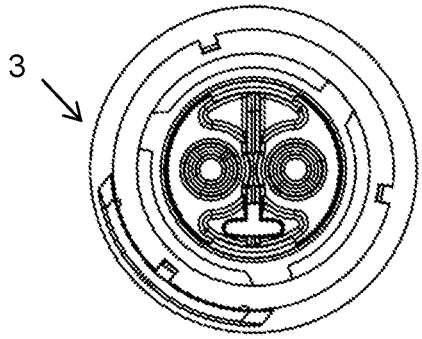
FIG. 36 shows a view from below of the closure element of FIG. 32.
Figure 37:
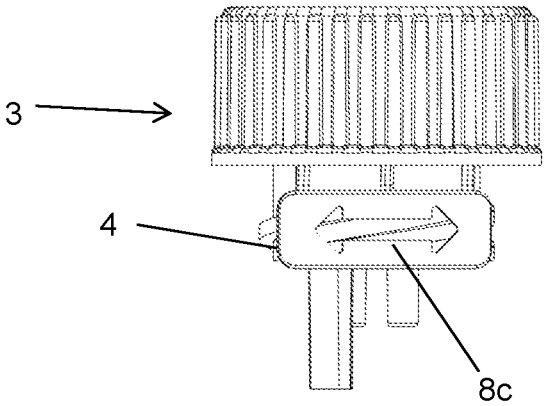
FIG. 37 shows a second lateral view of the closure element of FIG. 32.
Figure 38:
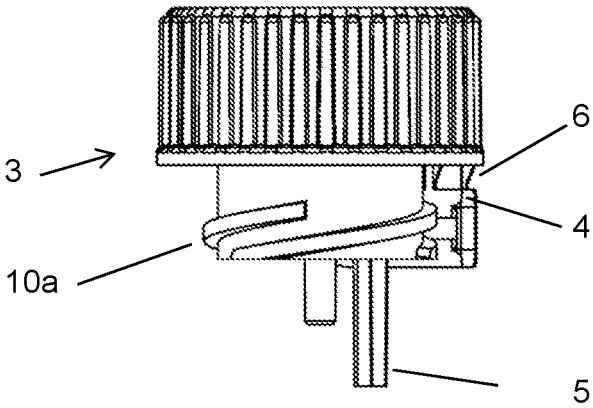
FIG. 38 shows a frontal view of the closure element of FIG. 32.
Figure 39:
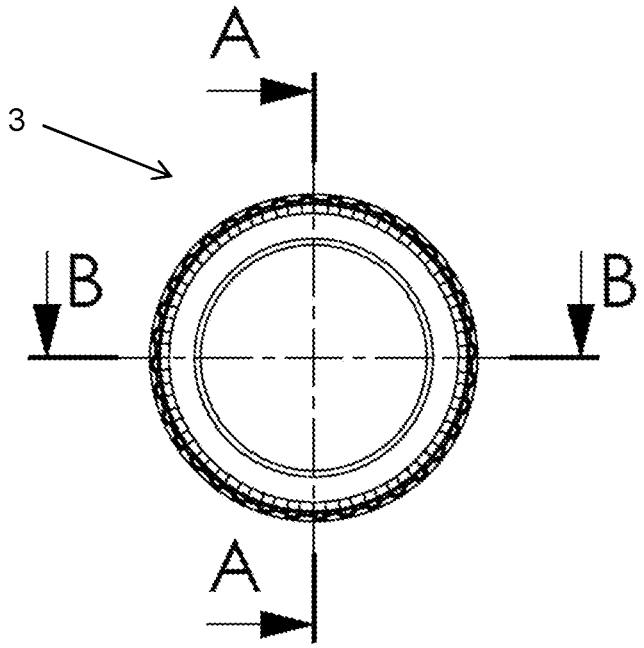
FIG. 39 shows the view from above of FIG. 35 with the sectional planes A-A and B-B.
Figure 40:
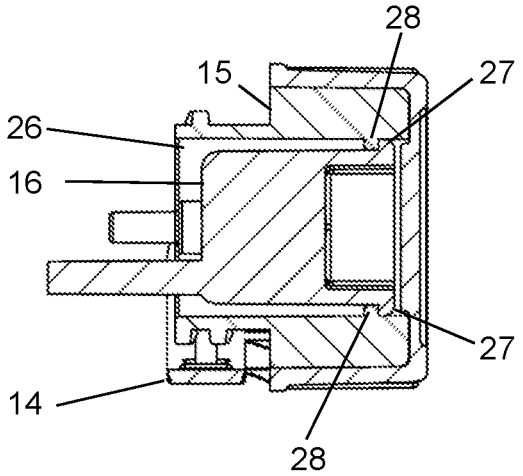
FIG. 40 shows a sectional view of the view from above of FIG. 38 along the plane A-A.
Figure 41:
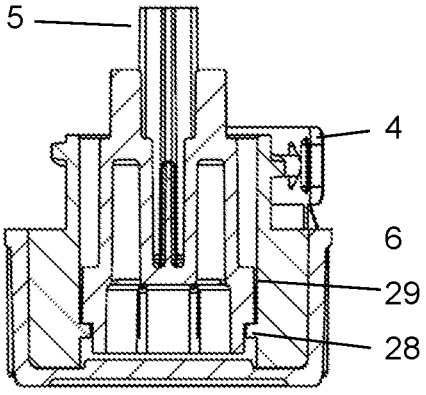
FIG. 41 shows a sectional view of the view from above of FIG. 38 along the plane B-B.

FIG. 39 corresponds to the view from above of FIG. 35, but shows, however, the sectional planes A-A and B-B, the sectional view of which are shown in FIGS. 40 and 41.

The sectional view of FIG. 40 shows the operating principle of the axial securing of the closure insert 16 in the fastening ring 15. Both locking tabs 27, which are positioned diametrically opposite to one another, engage behind the annular projection 28 encircling the internal contour of the opening 26, and thus prevent a further axial movement of the closure insert 16 in the direction of the positioning tongue 5, so that the closure insert 16 is held in a loss-secure manner. At the same time, an unscrewing of the closure element 3 permits an extraction of the bearing pins 3*c* out of the corresponding outlets 9 of a cartridge (not depicted).

The invention claimed is:

1. An application system with a cartridge comprising:

at least two containers, each of the at least two containers including an outlet; and a closure element comprising at least two pins for sealing the outlet of each of the at least two containers, the closure element configured to sealingly close the outlet of each of the at least two containers in a delivery state of the cartridge by engagement of the at least two pins in the outlet of each of the at least two containers, whereby, in a storage state, the closure element sealingly closes the cartridge, wherein, in a state of use of the cartridge, the closure element is removable from the cartridge and a corresponding accessory part is connectable with the outlet of each of the at least two containers, wherein, the cartridge or the closure element comprises, in the delivery state, a connecting element that cannot be removed without being destroyed, and that the cartridge or the closure element is, in the storage state, connected by the connecting element that cannot be removed without being destroyed with the closure element or with the cartridge, and that, upon the detachment of the connecting element sealingly closing the closure element from the cartridge, a color coding of the connecting element remains on the cartridge and/or the closure element.

2. The application system in accordance with claim 1, wherein the connecting element comprises at least one predetermined breaking point for the separation of the closure element from the cartridge or of the cartridge from the closure element, wherein the at least one predetermined breaking point is designed in such a way that the severing of the at least one predetermined breaking point produces an optical, acoustic, and/or haptic signal.

3. The application system in accordance with claim 1, wherein the connecting element is connected with the cartridge in a firmly bonded or positively locking manner.

4. The application system in accordance with claim 1, wherein the connecting element is connected with the closure element in a firmly bonded or positively locking manner.

5. The application system in accordance with claim 1, wherein the connecting element comprises a three-dimensional contour.

6. The application system in accordance with claim 5, wherein the connecting element comprises at least one contrast-forming three-dimensional contouring.

7. The application system in accordance with claim 6, wherein the at least one contrast-forming three-dimensional contour forms at least one recess.

8. The application system in accordance with claim 1, wherein the corresponding accessory part comprises an applicator or a mixer, connectable with the outlet of each of the at least two containers, wherein the corresponding accessory part comprises a coding corresponding to the color coding of the connecting element.

9. The application system in accordance with claim 8, wherein the corresponding accessory comprises a positioning tongue, which is provided with the corresponding coding.

10. The application system in accordance with claim 1, wherein the cartridge comprises a first threading or a first bayonet means and that the closure element comprises a second threading or a second bayonet means which, in the storage state and/or in the delivery state, engages with the first threading or the first bayonet means.

11. The application system in accordance with claim 1, wherein the connecting element is designed in one piece with the closure element and is connected with the cartridge in a firmly bonded or positively locking manner, or that the connecting element is designed in one piece with the cartridge and is connected with the closure element in a firmly bonded or positively locking manner.

12. The application system in accordance with claim 1, wherein the connecting element is designed and positioned in such a way that the connecting element is severed upon the opening of the closure element.

13. The application system in accordance with claim 1, wherein the connecting element is designed and positioned in such a way that a part of the connecting element is visible from an outside after the connecting of the corresponding accessory with the outlet of each of the at least two containers.

* * * * *